US007247094B2

(12) United States Patent
Hosaka

(10) Patent No.: US 7,247,094 B2
(45) Date of Patent: Jul. 24, 2007

(54) GAME MACHINE AND GAME SYSTEM

(75) Inventor: Toshiyuki Hosaka, Matsumoto (JP)

(73) Assignee: Seiko Epson Corporation (JP)

( * ) Notice: Subject to any disclaimer, the term of this patent is extended or adjusted under 35 U.S.C. 154(b) by 845 days.

(21) Appl. No.: 10/684,128

(22) Filed: Oct. 10, 2003

(65) Prior Publication Data

US 2004/0147310 A1 Jul. 29, 2004

(30) Foreign Application Priority Data

Oct. 11, 2002 (JP) ..... 2002-298988
Jun. 27, 2003 (JP) ..... 2003-185620

(51) Int. Cl.
*A63F 9/24* (2006.01)

(52) U.S. Cl. ..... 463/17

(58) Field of Classification Search ..... None
See application file for complete search history.

(56) References Cited

U.S. PATENT DOCUMENTS 5,083,271 A * 1/1992 Thacher et al. ..... 700/92
5,458,333 A * 10/1995 Takemoto et al. ..... 463/25
5,516,104 A * 5/1996 Takemoto et al. ..... 463/26
5,534,685 A * 7/1996 Takemoto et al. ..... 235/487
5,683,082 A * 11/1997 Takemoto et al. ..... 273/121 B

FOREIGN PATENT DOCUMENTS

JP 2000-296222 10/2000

* cited by examiner

*Primary Examiner*—Mark Sager
(74) *Attorney, Agent, or Firm*—Harness, Dickey & Pierce, P.L.C.

(57) ABSTRACT

A game machine is provided that comprises a main controller to record reserved number data readably in an external device and a data communication unit. A lending management unit selectively performs either settlement lending processing to lend game balls corresponding to a lending fee when the lending fee of the game balls has been settled according to a predetermined settlement method, or reservation lending processing to lend game balls within the range of the reserved number of game balls specified on the basis of the reserved number data recorded in the external device. A game mechanism is constructed to cyclically use a predetermined number of game balls, supplying to a game ball shooting section all those balls that have passed through the winning section and that have been collected through a game ball collection pocket, and that have been contained in a game ball receiver.

18 Claims, 18 Drawing Sheets

GAME MACHINE AND GAME SYSTEM

BACKGROUND

1. Technical Field

The present invention relates to a game machine constructed to be capable of disbursing a predetermined number of game balls in response to a game ball entering a winning pocket to win a prize, or a predetermined number of coins (medals) in response to 'bingo' by lot drawing, and a game system constructed to be capable of making a prize exchange within the range of the disbursed (reserved) number of game balls or coins.

2. Related Art

Pachinko machines (or game machines) of such type (for instance, a pachinko machine as disclosed in Japanese Unexamined Patent Application Publication No. 2000-296222) are generally installed in pachinko shops. When a game is played with the conventional pachinko machine, a prepaid card is first purchased for borrowing pachinko balls (game balls). Next, seated in front of a desired pachinko machine, a user inserts the prepaid card into a card insertion slot of a ball lending device to borrow the desired number of pachinko balls and then manipulates a handle. At this time, a ball shooting section of the pachinko machine shoots the pachinko balls with a force according to a manipulated state of the handle. As a result, the pachinko balls move (fall) down on the surface of a game board. Then, when a pachinko ball enters a winning pocket to win a prize, a reel of a display unit arranged at the center of the game board is rotated to open a big wining pocket when this reel stops at a "bingo". Further, when a pachinko ball enters the opened big winning pocket to win a prize, a predetermined number of pachinko balls are disbursed to a ball receiver.

In this case, the conventional pachinko machine allows a user to enjoy only a fixed kind of game. Therefore, when a user wants to play a game with another pachinko machine different from the one played until then, it is necessary to collect the pachinko balls in the ball receiver into a ball box, to carry the ball box to a counter, and then to count the number of balls by the counter. Thereafter, the user borrows pachinko balls out of another desired pachinko machine and manipulates a handle similar to the way described above. With them, the user can enjoy the game in a different pachinko machine. Further, when the game is completed, the pachinko balls in the ball receiver are put back in the ball box and taken to the counter, and the number of balls is counted with the counter. At this time, the counter counts the number of inputted pachinko balls to make a printer output the result. Thereafter, the user presents the piece of paper with the number of pachinko balls printed by the counter to a prize exchange office, so that a desired prize will be exchanged within the range of the number of dropped-out balls.

However, the conventional pachinko machine has the following problems. That is, the pachinko machine is installed in a pachinko shop along with a ball lending device or a ball-conveying device. In order to play a game with the pachinko machine, therefore, it should be taken for granted that a user is required to go to the pachinko shop. Meanwhile, a player who enjoys playing pachinko games desires to play games in a pachinko machine conveniently anytime or anywhere like when waiting for subways or resting after lunch. In case of the conventional pachinko machine, a large-scaled facility is required to accommodate a ball conveying mechanism to convey pachinko balls or the like. Since the conventional pachinko machine cannot be installed with ease in station premises or dining rooms, there has been a problem that it cannot fully satisfy the player's wish. Further, conventional pachinko machines have been used to play a specific game, one game per machine, a user has needed to collect the pachinko balls in the ball receiver into a ball box, to take the ball box to the counter, and then to count the number of balls by the counter. Thereafter, the user may move to another desired pachinko machine for another game.

Therefore, there is another problem that it is difficult for the user to play a plurality of games using conventional pachinko game machines.

The present invention has been made in consideration of such problems. It is therefore one object of the present invention to provide a game machine and a game system that can be easily installed in a station premise or restaurant. Further, it is another object of the present invention to provide a game machine and a game system that makes it possible for a user to enjoy a plurality of games with ease.

SUMMARY

In order to accomplish the object of the present invention, a game machine (or a pachinko machine) related to the present invention is provided with a lending management unit for managing the lending of game balls; a game mechanism having a game ball shooting section for shooting the game balls to the surface of a game board, and a winning section arranged on the game board for allowing the game balls to pass therethrough; a controller for performing winning processing to cause a predetermined number of the game balls to be disbursed to a ball receiver when the game balls have passed through the winning section, for calculating the number of kept game balls on the basis of the disbursed number of game balls, the number of game balls lent by the lending management unit, and the number of game balls shot by the game ball shooting section, and for generating reserved number information on the game balls on the basis of the calculated number of game balls; and a kept number display unit for displaying the number of kept game balls, the game machine comprising a reserved number recording unit (a reserved ball number recording unit) for readably recording in an external device the reserved number information generated by the controller, wherein the lending management unit selectively performs either settlement lending processing to lend the number of game balls corresponding to a lending fee when the lending fee of game balls is settled according to a predetermined settlement method, or reservation lending processing (reserved ball lending processing) for lending the game balls within the range of the reserved number (the reserved number of balls) specified on the basis of the reserved number information recorded in the external device, and wherein the game mechanism is constructed to cyclically use a predetermined number of game balls to thereby supply to the game ball shooting section the game balls that have past through the winning section, the game balls that are collected from a game ball collection pocket, and the game balls that are contained in the ball receiver.

According to the above game machine, the game balls are cyclically used, so that there is no need for facilities such as ball-conveying mechanism used, so that there is no need for facilities such as a ball-conveying mechanism for conveying game balls to the game machine or the game lending device or a counter for counting obtained game balls while a playing games. Therefore, the game machine can be installed in stations or dining rooms to thereby provide pachinko gamers an environment for playing a game conveniently at any time. In this case, in contrast to the game played with a virtual pachinko machine, for instance, a game played with a virtual mechanism virtually displayed on the display unit, in the game machine related to the present invention, a game using an actual game machine, in which game balls fall down on the game board, is played, a favorable game can be provided to the pachinko players.

Further, in the game machine related to the present invention, a top opening of the ball receiver is covered with a transparent material, and the lending management unit supplies the lent game balls to the ball receiver. According to this game machine, it is possible to avoid any possibility of losing the game balls as in the case that the user carries the game balls away with him, while a user can see the disbursed game balls.

Furthermore, the game machine related to the present invention further comprises: a storage unit for storing image information corresponding to respective game images for a plurality of kinds of games and display procedure information indicating the display procedure of the game images for the plurality of kinds of games; an image display unit for displaying the game images according to the image information and the display procedure information stored in the storage unit; and an operation for selecting any one of the plurality of kinds of games, wherein, when any one of the games is selected with the selection, the controller outputs specific information capable of specifying the display procedure information on the selected game to the image display unit, and wherein the image display unit displays the corresponding game image according to the display procedure information specified by the specific information outputted by the control unit.

According to the above game machine, a plurality of kinds of games can be enjoyed by a player in a single game machine without installation of a plurality of game machines for different kinds of games. Further, in contrast to the conventional game machine, other kinds of games can also be started swiftly and easily.

Thus, a player can enjoy a plurality of games easily.

Further, in the game machine related to the present invention, the image display unit comprises a projection mechanism for projecting the corresponding game image onto the game board from the back side thereof; and a display controller for making the projection mechanism project the corresponding game image according to the display procedure information specified based on the specific information, and wherein the storage unit stores board surface pattern information on respective board surface patterns for the games, and the display controller makes the projection mechanism project the corresponding board surface pattern and the game images for the selected game according to the specific display procedure information.

According to the above game machine, a plurality of kinds of games can be enjoyed by a user in a single game machine without the installation of a plurality of game machines for different kinds of games. Further, in contrast to the conventional game machine, other kinds of games can also be started swiftly and easily.

Thus, a player can enjoy a plurality of games easily. The display controller makes the projector project a board surface pattern and a game image for the selected game in accordance with the specific information. Thus, for instance, in contrast to an image display unit constructed with an LCD panel or a CRT, board surface patterns can be changed in accordance with the changes in the games. Therefore, in comparison with changes in the game images displayed on an LCD panel, a CRT or the like, much more favorable display images can be displayed.

Moreover, in the game machine according to the invention, the winning section comprises a hole or a cutout formed to pass the game balls falling from the surface of the game board from one surface to the other surface thereof, and a game ball detection sensor for outputting a detection signal when the corresponding game ball has passed through the corresponding cutout or hole.

According to the above game machine, all the game balls that have been shot out by the game ball shooting section (except game balls that have entered a big hit prize hole) can be recovered from the game ball collection pocket. As a result, the game ball collection mechanism can be constructed simply and easily, which makes it possible to construct the game machine more easily than a game machine having the winning section of such a type that collects game balls at the back side of the game board.

Further, in the game machine of such a type that collects game balls at the back side of the game board, a tube for moving the collected game balls may deter the projection of display images (due to the shadow of the tube). However, according to the winning section of the present invention, a tube is not needed, so that display images can be projected and displayed without a shadow of a tube and the like.

Further, the game machine according to the invention further comprises a plurality of winning sections which are slidably arranged on the game board between a protruded position protruding from the surface of the game board for allowing the game balls to pass through the hole or cutout, and a recessed position recessed into the game board for preventing the game balls from passing through the hole or cutout, and wherein the control unit makes each winning section slide to the protruded or recessed position in accordance with the selected game. According to this game machine, it is possible to provide much more favorable games than a game machine (a game machine fixed on the game board with the winning section in a protruded state) in which only the board surface pattern or the game image is changed.

Furthermore, the game machine related to the present invention further comprises at least one of accessories and a plurality of nails which are movably arranged on the surface of the game board, wherein the controller moves at least one of the accessories and the plurality of nails in accordance with the selected game.

According to the above game machine, it is possible to provide much more favorable games with various changes than a game machine (a game machine fixed on the game board without any movement) in which only the board surface pattern or the game image is changed.

A game machine related to the present invention is provided with a lending management unit for lending coins (medals); a game mechanism having an input hole for inserting the coins and a handle for starting a lot drawing; a controller for performing lot-drawing processing in response to the coin insertion and manipulation of the handle, to thereby make the coin mechanism disburse a predetermined number of coins to a coin receiver when a winning lot is generated in the lot-drawing processing, calculating the number of kept coins on the basis of the disbursed number of coins, the number of coins lent by the lending management unit, and the number of coins inserted into the coin input hole, and generating information on the reserved number of coins on the basis of the calculated number of kept coins; and a kept number display unit for displaying the number of kept coins, the game machine comprising: a reserved number recording unit for readably recording in an external device information on the reserved number of coins generated by the controller, wherein the lending management unit selectively performs either settlement lending processing to lend the number of coins corresponding to a lending fee when the lending fee of coins is settled according to a predetermined settlement method, or reservation lending processing for lending the coins within the range of the reserved number of coins specified on the basis of the information on the reserved number of coins recorded in the external device, and wherein the game mechanism is constructed to cyclically use a predetermined number of coins including the coins that have been inserted into the coin input hole and the coins in the coin receiver.

According to the above game machine, there needs neither a conveying device for conveying coins to the game machine or lending machine nor the counter for counting obtained coins while a playing games. Therefore, the game machine can be installed in stations or dining rooms to thereby provide an opportunity to play games for a player conveniently at any time. In this case, in contrast to the game played with a virtual game machine, for instance, a game played with a virtual game machine in which only the obtained number of coins is virtually displayed on the display unit, in the game machine related to the present invention, a game using an actual game machine, in which actual coins are disbursed to the coin receiver, is played, a favorable game can be provided to the player.

In the game machine related to the invention, a top opening of the coin receiver is covered with a transparent material, and the lending management unit supplies the lent coins to the coin receiver, and the coins in the coin receiver are inserted into the coin input slot by a conveying mechanism. According to this game machine, it is possible to avoid any possibility of losing the coins as in case that the user carries the coins away with him, while the user can see the disbursed coins.

Furthermore, the game machine related to the invention further comprises: a storage unit for storing image information corresponding to respective game images for a plurality of kinds of games and display procedure information indicating the display procedure of the game images for the plurality of kinds of games; an image display unit for displaying the game images according to the image information and the display procedure information stored in the storage unit; and a manipulator for selecting any one of the plurality of kinds of games, wherein, when any one of the games is selected by the selection, the controller outputs specific information capable of specifying the display procedure information on the selected game to the image display unit, and wherein the image display unit displays the corresponding game image according to the display procedure information specified by the specific information outputted by the control unit.

According to the above game machine, a player can enjoy a plurality of kinds of games using coins in a single game machine. Thus, a player can enjoy a plurality of kinds of games using coins easily. Further, according to this game machine, the display controller makes the projection mechanism project a board surface pattern and a game image for a selected game in accordance with the specific information, thereby making a change in the game board patterns in accordance with the change of the game.

In the game machine related to the present invention, the image display unit comprises a projection mechanism for projecting the corresponding game image to a game board, from the back side thereof, arranged at the front side of the game machine, and a display controller for making the projection mechanism project the corresponding game image according to the display procedure information specified based on the specific information, wherein the storage unit stores board surface pattern information on respective board surface patterns for the games, and the display controller makes the projection mechanism project the corresponding board surface pattern and the game images for the selected game according to the specific display procedure information.

According to the above game machine, a player can enjoy a plurality of kinds of games in a single game machine. Thus, a player can enjoy a plurality of kinds of games using coins easily. Further, the display controller makes the projection mechanism project a board surface pattern and a game image for a selected game in accordance with the specific information, thereby making a change in the game board patterns in accordance with the change of the game.

Further, in the game machine related the invention, the lending management unit is constructed to perform the settlement lending processing for receiving the lending fee by using any method including cash, prepaid cards, or substitute settlement means as a predetermined settlement method. In this case, the substitute settlement means of the present invention includes various substitute settlement means such as settlement means to settle the lending fee of the game balls along with the telephone bill of the player's cellular phone or credit cards.

According to the above game machine, for instance, if a prepaid card is not held, the coins can be borrowed in cash. If cash is not held, the prepaid card is used to borrow coins to play games.

Furthermore, in the game machine related to the present invention, the reserved number recording unit makes the external device record the reserved number information in relation to prescribed certifying information, and wherein the lending management unit allows for the lending when the input information inputted at the time of the lending processing is identical to the predetermined certifying information. According to this game machine, it is possible to definitely prevent a third party (for instance, a person who happens to obtain a member card) other than the gamer who has obtained the reserved number of game balls from borrowing the game balls or exchanging them for prizes.

In the game machine related to the present invention, the reserved number recording unit makes a removable media, serving as the external device, record the reserved number information readably. According to this game machine, a device for exclusive use of information recordation, such as a central management device, is not required in a game system. As a result, it is possible to construct the game system simply and easily.

In the game machine related to the present invention, the reserved number recording unit readably records the reserved number information in the external device directly through a communication network or through other devices. According to this game machine, it is possible to avoid intentionally changing the reserved number information. When a game is played by a plurality of scattered game machines, further, the game balls can be borrowed within the range of the reserved number specified by the reserved number information recorded in the external device.

Further, a game system related to the present invention comprises the aforementioned game machine and a central management device, serving as an external device, constructed to be accessible to the game machine through a communication network for recording the reserved number information.

Further, the game system of the present invention further comprises a prize exchange processing device constructed to be accessible to the central management device through the communication network for reading the reserved number information directly or through other devices from the central management device, for performing a prize exchange process within the range of the reserved number of coins specified by the reserved number information to thereby generate new reserved number information reduced by the reserved number corresponding to the exchanged prize, and for recording the generated new reserved number information to the central management device directly or through other devices.

According to the above game system, similar to the games using the conventional game machines, it is possible to make an exchange for prizes within the range of the obtained reserved number. In this case, according to this game system, in contrast to the prize exchange that has been made in the conventional pachinko shop, it is possible to reduce the user's inconvenience of carrying the dropped-out game balls in the ball box to the counter.

Further, in the game system related to the present invention, the game machine is installed in a movable box, and the box has illumination equipment installed therein.

According to the above game system, the box can be moved to a location for installation in such a state that the game machine and illumination equipment are installed therein beforehand, thereby making it possible to install the game machine in a station premise or dining room with ease. Further, in comparison with the installation of the conventional game machine exposed in a station, the game system of the present invention makes it possible to provide an environment where a user can better concentrate on a game.

DETAILED DESCRIPTION

Hereinafter, a preferred embodiment of a game machine and a game system according to the present invention will be described with reference to the accompanying drawings.

Figure 1:
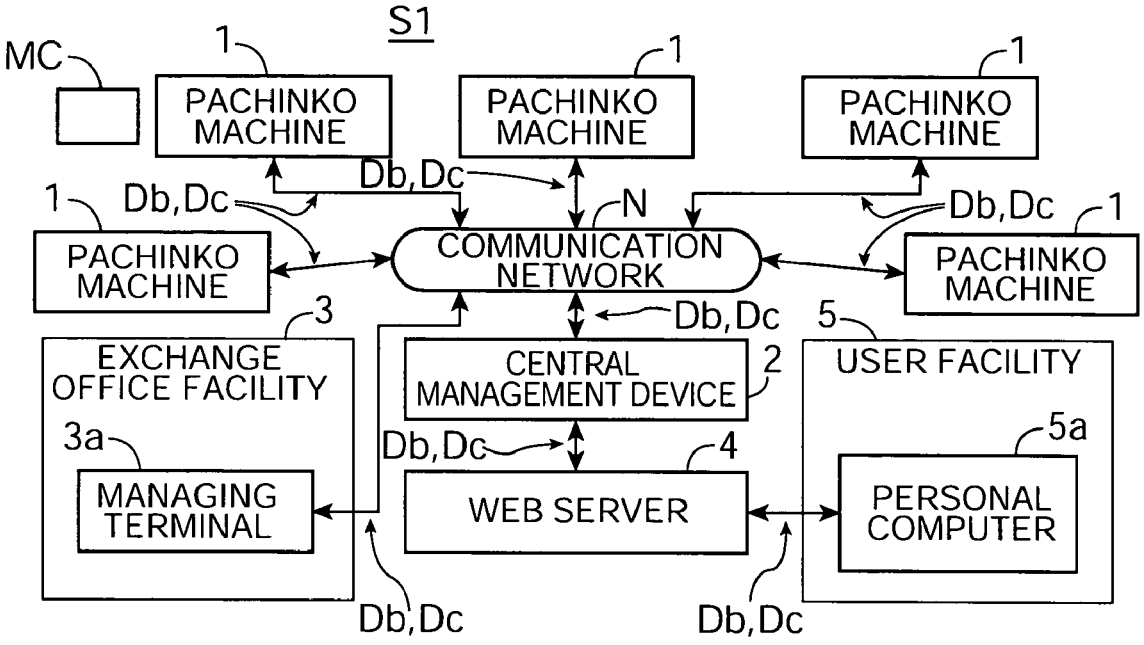
FIG. 1 is a block diagram illustrating the construction of a game system S1.

At first, the construction of a game system S1 will be described with reference to the drawings. The game system S1, as shown in FIG. 1, comprises a plurality of pachinko machines (game machines) 1, a central management device 2, an exchange office facility 3, a web server 4 and a user facility 5. In this case, the pachinko machine 1 is installed in a pachinko box (a box of the invention, not shown here) in which air-conditioning installation, illumination equipment and a sound facility (not shown) are installed so that a user is allowed to enter, thereby providing an individual room for exclusive pachinko. In this case, the pachinko box is constructed to be movable with, for example, about one to three pachinko machines 1 installed therein. Further, the pachinko box can be installed in any place like station premises, dining rooms, or department stores. Moreover, five pachinko machines 1, one exchange office facility 3 and one user facility 5 are illustrated as an example in the drawing. However, actually, there are a far greater number of pachinko machines 1, a plurality of exchange office facilities 3 and a plurality of user facilities 5.

Figure 2:
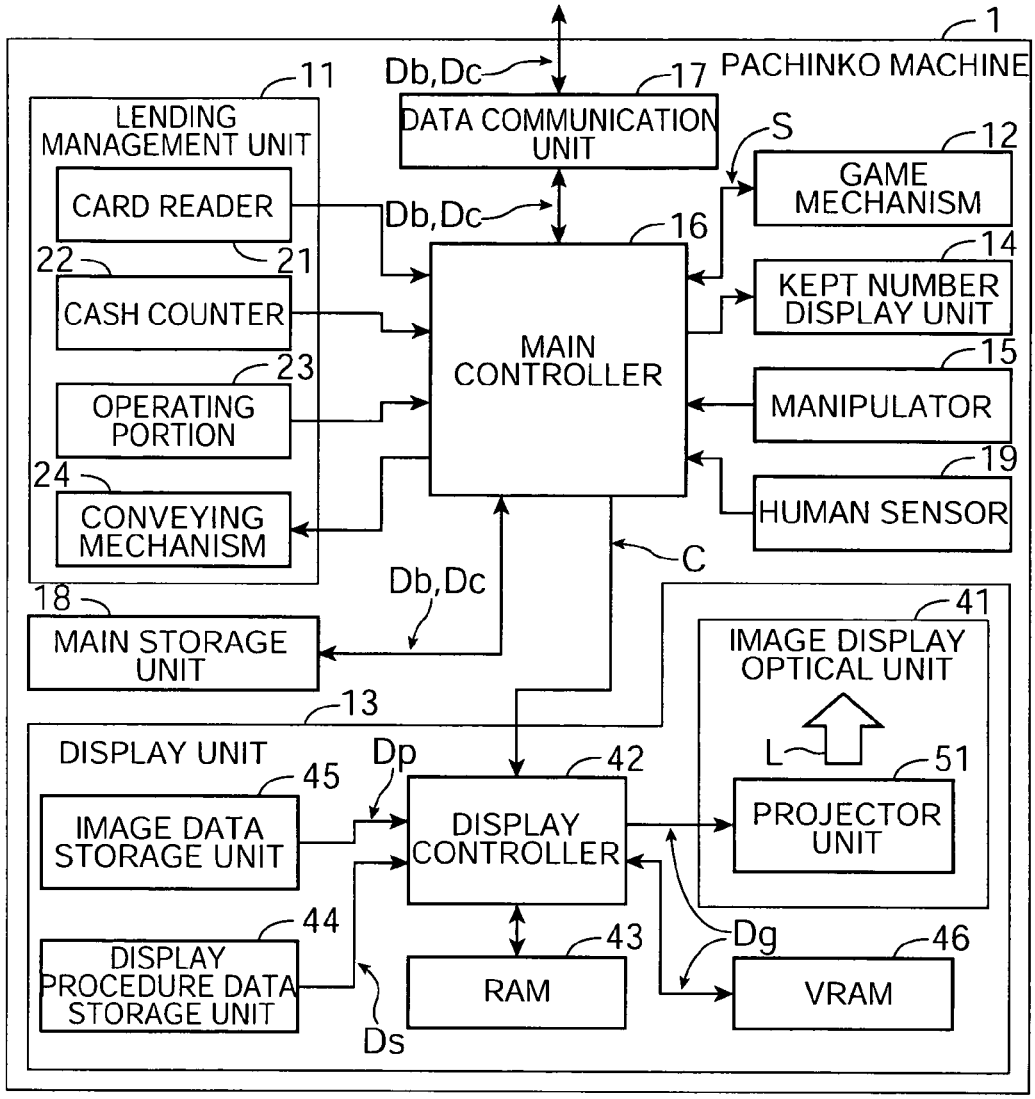
FIG. 2 is a block diagram illustrating the construction of a pachinko machine 1.

For instance, the pachinko machine 1 is a so-called 'seven machine' type of pachinko machine where a 'bingo' is hit by lot drawing. The pachinko machine 1 is constructed such that, when projection light L (Refer to FIG. 4) is projected to the back side of a game board 31, a display image G (for instance, a board surface pattern Gb including a big land and Mt. Fuji shown in FIG. 3 and a game image Gy constructed with numerals '123') can be displayed on the game board 31 thereof. Specifically, as shown in FIG. 2, the pachinko machine 1 comprises a lending management unit 11, a game mechanism 12, a display unit 13, a kept number display unit 14, a manipulator 15, a main controller 16, a data communication unit 17, a main storage unit 18 and a human sensor 19.

Figure 3:
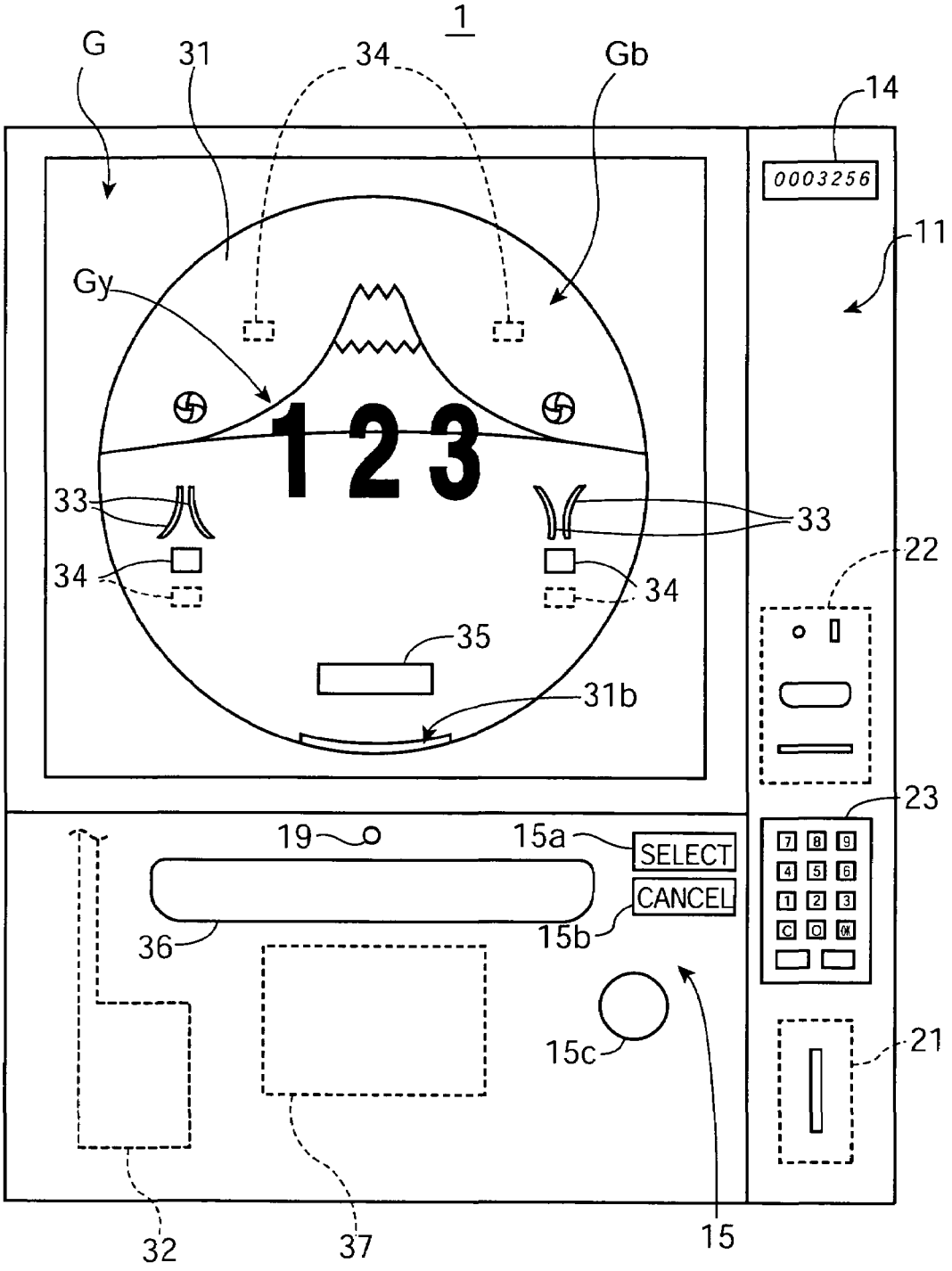
FIG. 3 is a front view illustrating the schematic construction of the pachinko machine 1.
Figure 6:
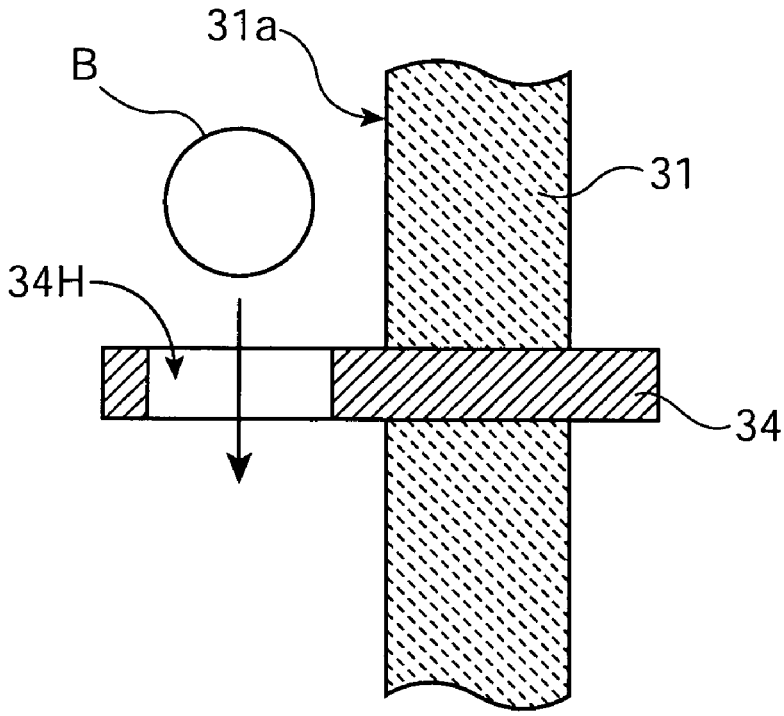
FIG. 6 is a cross-section view illustrating a protruded state of the winning section 34 and a game board 31.

The lending management unit 11 includes a card reader 21, a cash counter 22, a operating portion 23 and a conveying mechanism 24, all of which constitute the lending management unit in the present invention along with the main controller 16. As shown in FIG. 3, the lending management unit 11 is arranged at the right end of the pachinko machine 1. The card reader 21 is configured such that it can read a variety of information from a membership card MC (Refer to FIG. 1. For instance, a magnetic card, an IC card, or the like) in which membership number data relating to membership number individually given to a user of the game system S1 is recorded, or from a credit card (an example of substitute settlement means in the present invention). The cash counter 22 calculates coins or bills (hereinafter, simply referred to as 'cash' if not distinguished separately) inserted into a coin input slot or a bill input slot, outputs data on the amount of money and collects the received cash. The operating portion 23 has an arrangement of various manipulation buttons including input buttons of figures '0' through '9', an OK button, or a cancellation ('C') button. The conveying mechanism 24 conveys a predetermined number of pachinko balls B (game balls in the present invention as shown in FIG. 6) from a containment section 37 (refer to FIG. 3) and discharges them to a ball receiver 36 (refer to FIG. 3) when the main controller 16 endorses the lending of the pachinko balls B.

Figure 4:
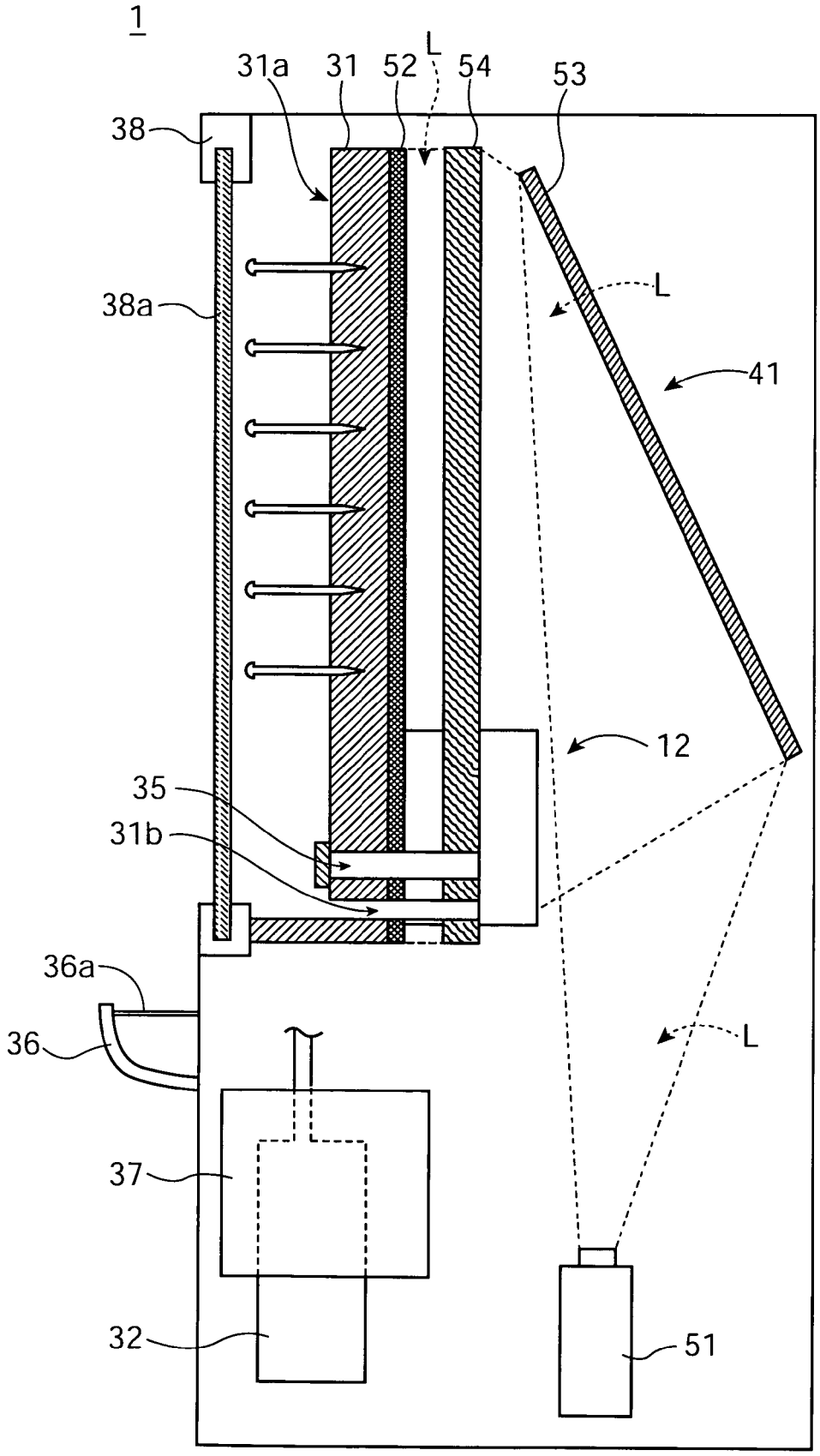
FIG. 4 is a lateral cross-section view illustrating the schematic construction of the pachinko machine 1.

As shown in FIG. 4, the game mechanism 12 includes a game board 31, ball shooting section 32, a gauge 33 (an accessory and a plurality of nails in the present invention as shown in FIG. 3), a hit prize section 34 (refer to FIG. 3), a big hit prize hole (attacker) 35, a ball receiver 36 and the containment section 37. The surface 31*a* of the game board 31 is shaped in a flat plate as a whole for allowing the pachinko balls B to move (fall down) thereon and a ball collection pocket 31*b* is opened for collecting the pachinko balls B that have fallen to the lowest end thereof (screen film 52). Further, the game board 31 is made of light transmissible resin to make visible the display image G projected to the back side thereof, and it also has attached thereon a plurality of nails, a windmill (refer to FIG. 3), gauges 33, hit prize sections 34 and the big hit prize hole 35. The front door 38 having fitted thereinto a transparent glass plate 38*a* is arranged in the front side of the game board 31. The ball shooting section 32 corresponds to the game ball shooting section of the present invention. As shown in FIG. 3, the pachinko balls B stored in the containment section 37 arranged in the lower left side of the pachinko case of the pachinko machine 1 are shot out to the surface 31*a* of the game board 31 under the control of the main controller 16. A set of two gauges 33 are slidably (movably) mounted at the surface 31*a* of the game board 31 and rotated by a movement mechanism (not shown) to change the gap at the upper side of both gauges 33.

Figure 5:
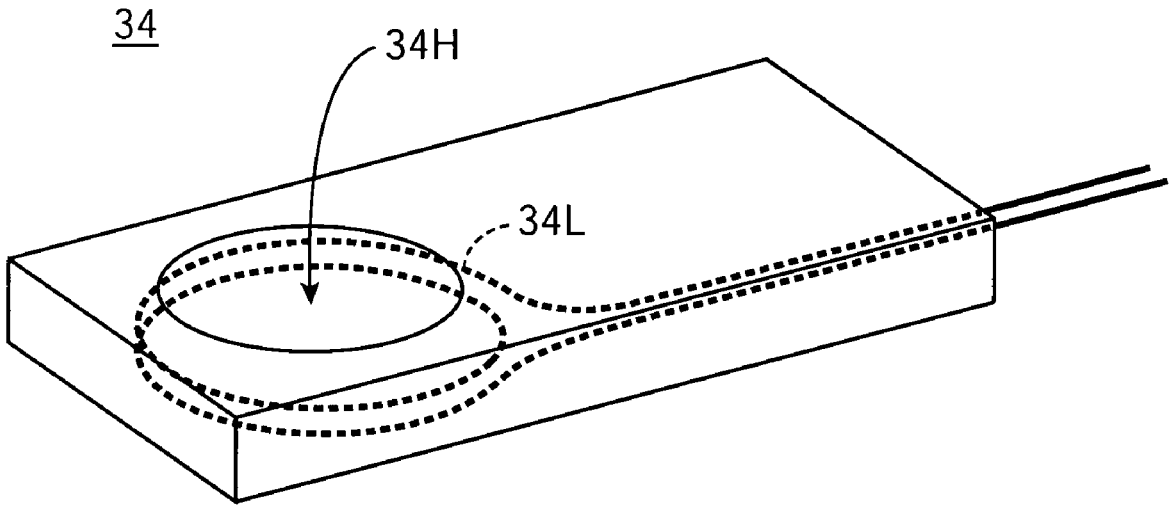
FIG. 5 is a perspective view illustrating the appearance of a winning section 34 in the pachinko machine 1.

The hit prize section 34 is constructed to be capable of passing along the falling direction of the pachinko balls B that falls along the surface 31*a* of the game board 31 when the balls B are shot out by the ball shooting section 32. Specifically, as shown in FIG. 5, the hit prize section 34 is, for instance, made of resin in a rectangular shape as a whole, and a circular hole 34H having a diameter slightly larger than that of the pachinko balls B is formed at the front end of the hit prize section 34. Further, a coil 34L (a pachinko ball detecting sensor in the present invention) is embedded to detect the pachinko ball B passing through the hole 34H to output a detection signal S. In this case, the lead wire of the coil 34L is passed through the hole communicating with the game board 31 and the screen film 52, and the front end of the coil 34L is connected to the transparent wiring film (not shown) adhered to the back side of the screen film 52. In this case, the transparent wiring film is connected to the main controller 16. Therefore, the coil 34L is connected to the main controller 16 through the transparent wiring film.

The hit prize section 34 is slidably mounted between the inner and front sides of the game board 31 and it is advanced and retreated (slid) by a movement mechanism (not shown).

Figure 7:
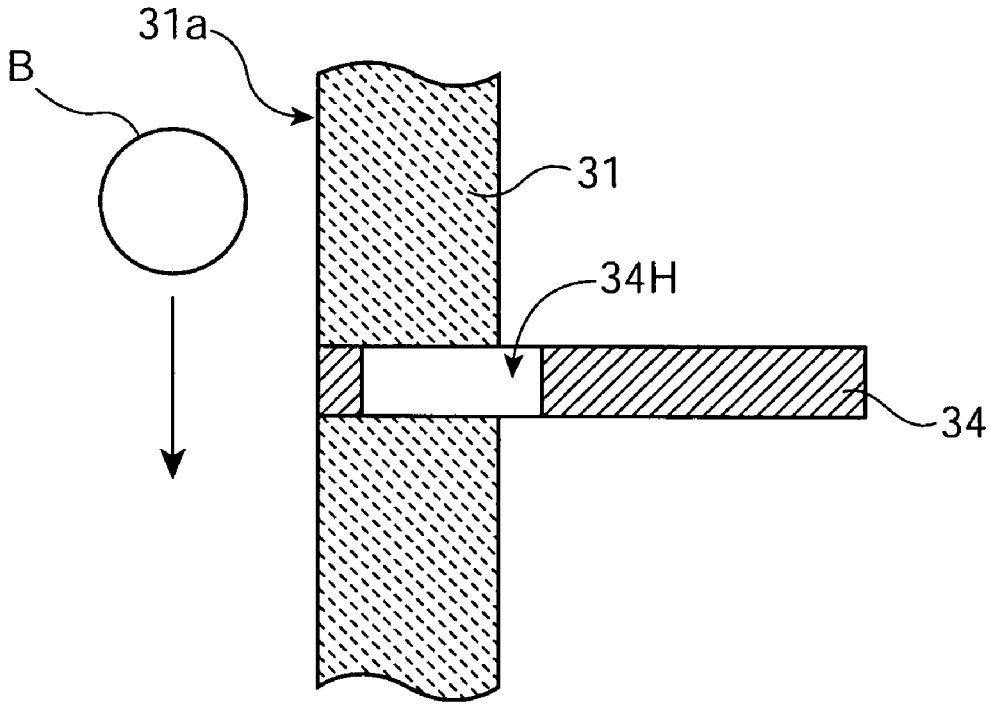
FIG. 7 is a cross-section view illustrating a recessed state of the winning section 34 and the game board 31.

In this case, as shown in FIG. 6, when the hit prize section 34 is moved to a state (a state moved to a "protruded position" in the present invention) protruded on the surface 31*a* of the game board 31 (hereinafter, referred to as a "protruded state"), the hit prize section 34 functions as a hit prize hole (a start chucker) in the pachinko machine 1 to make the coil 34L output a detection signal S to the main controller 16 when the pachinko ball B passes through the hole 34H. Further, as shown in FIG. 7, when the hit prize section 34 is in a state (a state moved to a "recessed position" in the present invention) recessed such that the side face on its front side becomes flush with the surface 31*a* of the game board 31 (hereinafter, referred to as a "recessed state"), the hit prize hole stops its function to thereby make the side face on its front side become a part of the game board 31. Further, the main controller 16 determines which hit prize sections 34 are set to a protruded or recessed state thereof according to a game selected by a user.

The big hit prize hole 35 is opened by the main controller 16 at the time of a 'bingo', which will be described below. As shown in FIG. 4, the ball receiver 36 is constructed to accommodate a plurality of pachinko balls B, and a top opening of the ball receiver 36 is covered with a transparent glass plate 36*a* (a transparent material in the present invention). The pachinko balls B lent by the lending management unit 11 are discharged to the ball receiver 36, and, when a pachinko ball B enters the big hit prize hole 35 to win a prize, a predetermined number of pachinko balls B are disbursed. The containment section 37 is arranged in the case of the pachinko machine 1 to be capable of dropping the pachinko balls B collected from the collection pocket 31*b*, pachinko balls B enters the big hit prize hole 35 to win a prize, and pachinko balls B contained in the ball receiver 36, and stores a predetermined number of pachinko balls B. In this case, a plurality of pachinko balls B are cyclically utilized in the pachinko machine 1. Specifically, at the time of disbursement of pachinko balls B (ejection of balls), a predetermined number of pachinko balls B are conveyed and ejected by the conveying mechanism 24 from the containment section 37 to the ball receiver 36 in the pachinko machine 1. Further, in contrast to the conventional pachinko machine, when pachinko balls are shot by the ball shooting section 32, one pachinko ball B falls down from the ball receiver 36 into the containment section 37, and one pachinko ball B is supplied from the containment section 37 and shot to the ball shooting section 32.

As shown in FIG. 2, the display unit 13 relating to the image display unit in the present invention, includes an image display optical unit 41, a display controller 42, RAM 43, a display procedure data storage unit 44, an image data storage unit 45, and VRAM 46. As shown in FIG. 4, the image display optical unit 41 includes a projector unit 51, a screen film 52, a mirror 53 and Fresnel lens 54. The projector unit 51 corresponding to the projection mechanism of the invention is arranged at a position close to the bottom in the case of the pachinko machine 1 to emit upwards the projection light L for displaying the display image G on the basis of the display image data Dg outputted by the display controller 42. Specifically, the projector unit 51, for instance, includes a light source lamp, modulating means (for instance, a liquid crystal light valve equipped with a liquid crystal panel, an incident-side polarizing plate or a irradiation-side polarizing plate) to modulate projection light L (white light) projected by a light source lamp into the projection light L shaded or colored in accordance with the display image G, and a projection lens (not shown) to project the enlarged projection light L (none of them is shown).

The screen film 52, as described above, is adhered to the back side of the game board 31. For instance, the screen film 52 receives and diffuses the projection light L projected by the projector unit 51 to thereby form the display image G. A mirror 53 is arranged at the back side of the game board 31 to reflect the projection light L projected by the projector unit 51 toward the screen film 52.

A Fresnel lens 54 is arranged between the mirror 53 and the screen film 52 to transform the projection light L projected by the projector unit 51 into a parallel light (a parallel light as a general term) and to form a display image G on the screen film 52.

Figure 8:
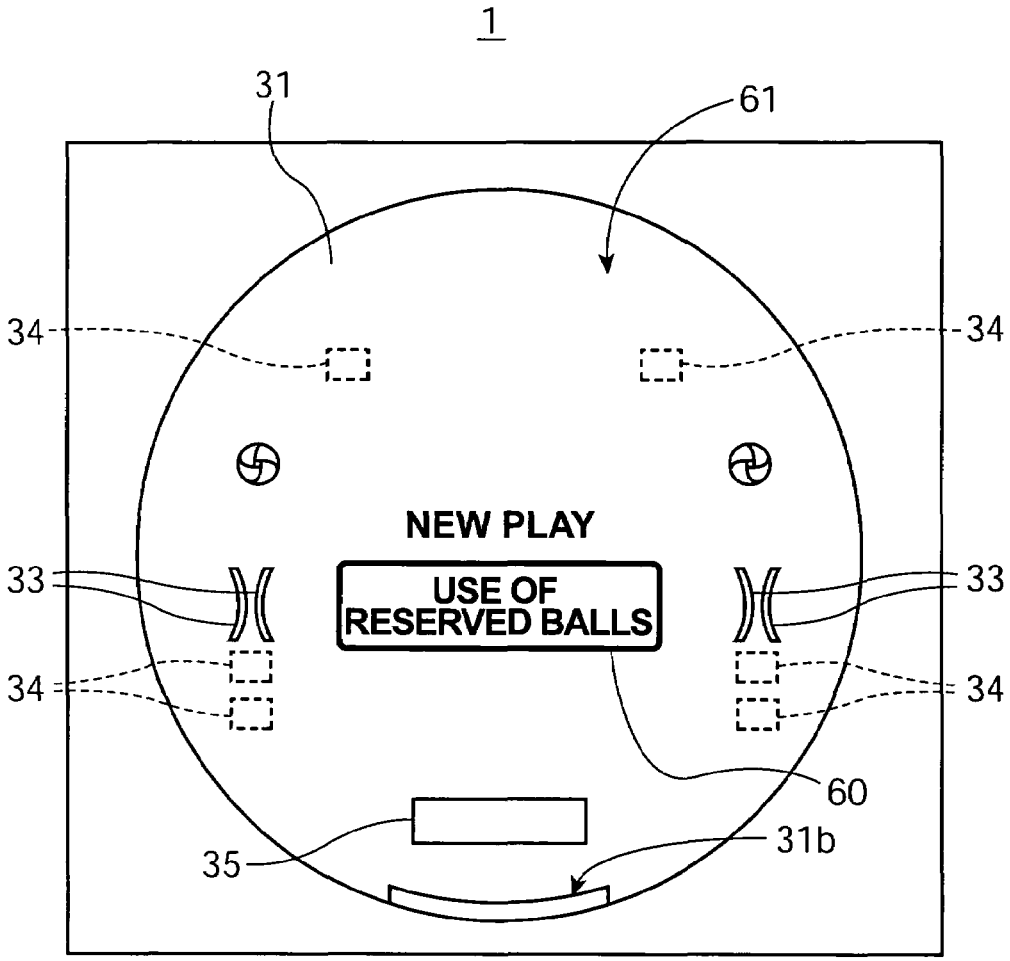
FIG. 8 is a display image view illustrating an example of a lending method selection screen 61 displayed on the game board 31 of the pachinko machine 1.

The display controller 42 is a controller for an exclusive use of displaying images. Various image display processes are performed according to the commands C outputted by the main controller 16, so as to generate display image data Dg including a display image G, a lending method selection screen 61 (refer to FIG. 8), an certifying screen 62 (refer to FIG. 9), and a game-selecting screen 63 (refer to FIG. 10), and then output them to the projector unit 51. The RAM 43 temporarily stores operational results of the display controller 42. The display procedure data storage unit 44 constitutes a storage unit in the present invention along with the image data storage unit 45. The display procedure data storage unit stores the display procedure data Ds (display procedure information in the present invention) in which the designation of image data to be used for the generation of display image data Dg, the designation of the display time and the position on the display screen to display an image, and the like are described, and operational program of the display controller 42. In this case, the pachinko machine 1 is constructed to select, for instance, two kinds of games (a plurality types of games in the present invention), for instance, which will be described below. As a result, the display procedure data storage unit 44 stores display procedure data Ds related to game 1 and display procedure data Ds related to game 2. The image data storage unit 45 stores various image data Dp (the image data in the present invention, such as image data on Mt. Fuji, land or figures, for instance) to generate the display image data Dg for each game. VRAM 46 stores the display image data Dg to be generated by the display controller 42.

Under the control of the main control unit 16, the kept number display unit 14 displays the number of pachinko balls B (hereinafter, referred to as the "kept number") which is obtained by the subtraction of the number of pachinko balls B shot by the ball shooting section 32 from the total number of the pachinko balls B lent by the lending management unit 11 and those disbursed to the ball receiver 36 at the time of a prize winning case. The manipulator 15 is, as shown in FIG. 3, includes a selection button 15*a* to select an item that has been selected with a cursor 60 (refer to FIG. 8) in the selection of a lending method, which will be described below, a cancellation button 15*b*, and a handle 15*c* to adjust the shooting force of a ball B by the ball shooting section 32 and to manipulate the movement of the cursor 60 on the lending method selection screen 61.

The main controller 16 corresponding to the control unit in the present invention generally controls the lending management unit 11, the game mechanism 12, the display unit 13, the kept number display unit 14, and the data communication unit 17. Further, the main controller 16 performs settlement lending processing of lending the number of pachinko balls B according to the amount of input money when cash is put in to the cash counter 22 of the lending management unit 11 and reservation lending processing of lending the number of pachinko balls B within the range of a reserved number specified by the reserved number data Db (the reserved number information) recorded in the central management unit 2. Further, the main controller 16 performs a scroll display of a game image Gy to the display unit 13 when a detection signal S is outputted by the hit prize section 34 (that is, a pachinko ball B passes through the hole 34H), and the main controller 16 opens the big hit prize hole 35 when a predetermined condition is satisfied (In this case, the display of a game image Gy is stopped at a 'bingo' state). Moreover, the main controller 16 makes the conveying mechanism 24 disburse a predetermined number of pachinko balls B to the ball receiver 36 when the pachinko ball B enters the big hit prize hole 35 to win a prize (a prize winning process in the present invention).

Further, the main controller 16 calculates the number of kept pachinko balls B by subtracting the number of pachinko balls B shot by the ball shooting section 32 from the total number of the pachinko balls B lent by the lending management unit 11 and those disbursed to the ball receiver 36 at the time of a prize winning case, displays the kept number on the kept number display unit 14 on the basis of the result of calculation, and generates the reserved number data Db on the basis of the reserved number when the game is completed (as will be described below, when the cancellation button 15*b* is manipulated). Moreover, the main controller 16 generates certifying data Dc (certification information in the present invention) on the basis of the membership number data read from a membership certificate MC by the card reader 21 and password data based on a password inputted by the manipulation buttons pressed by the operating portion 23. Furthermore, the main controller 16 outputs various commands C in accordance with a type of game to display various display images G to the display unit 13.

The data communication unit 17 constitutes a reserved number recording unit in the present invention along with the main controller 16. The data communication unit 17 reads (receives) the reserved number data Db and the certifying data Dc from the central management device 2 through a communication network N, when the reservation lending processing is performed by the main controller 16, and transmits the reserved number data Db and the certifying data Dc to the central management device 2 through the communication network N under the control of the main controller 16 when the game is completed. In this case, the communication network N includes various communication networks such as a wired telecommunication network or radio communication network. The main storage unit 18 stores the operational program of the main controller 16 and the game data respectively corresponding to games 1 and 2, which will be described below. The human sensor 19 is, as shown in FIG. 3, arranged at the front panel of the pachinko machine 1 to output to the main controller 16 a detection signal, when a user exists at the front side of the pachinko machine 1, to inform the main controller of the event.

On the other hand, the central management device 2, an example of an external device in the present invention, relates the reserved number data Db transmitted by the pachinko machine 1, the exchange office facility 3 and the user facility 5 to the certifying data Dc, to store it in, for example, an embedded hard disc drive. Further, the central management device 2 transmits the reserved number data Db to each pachinko machine 1, the exchange office facility 3 and the user facility 5 in relation to the certifying data Dc. In this case, for instance, a management company of the game system S1 manages the central management device 2. The exchange office facility 3 is a facility installed at the prize exchange office where a user makes an exchange with a desired prize within the range of the reserved number and where a managing terminal 3*a* is constructed to be capable of being connected to the central management device 2 through the communication network N. The managing terminal 3*a* is an example of the prize-exchange processing device in the present invention, and is connected to a card reader to read the membership number data from a membership card MC and a manipulator to input a password of a user (any of them are not shown). The managing terminal 3*a* receives the reserved number data Db and the certifying data Dc from the central management device 2, generates a new reserved number data Db by subtracting the reserved number used by the prize exchange from a specific reserved number based on the aforementioned reserved number data Db and then relates the new reserved number data to the certifying data Dc to transmits it to the central management device 2.

The web server 4, for instance, stores various digital contents concerning web sites operated by the management company of the game system S1. The web server 4 receives updated reserved number data Db from the central management device 2 in relation to the certifying data Dc and provides information such as the reserved number to the Internet-accessible terminal that satisfies predetermined conditions. Further, the web server 4 stores image data of prizes identical to those stocked in the prize exchange office along with the reserved number needed for an exchange of the prizes. The user facility 5 is a facility installed in the membership card MC holder's (user) house and includes a personal computer 5*a* (Internet-accessible terminal) to be accessible to the web server 4 through the Internet. In this case, the personal computer 5*a* is another example of the prize-exchange processing device in the present invention and perform a prize-exchange process within the range of the reserved number that the user obtains on the web site registered in the web server 4. Further, the personal computer 5*a* is not limited to the terminal that is exclusively used for the game system 1, but other kinds of Internet-accessible terminals to be used by the user may be also included as the terminal of the game system 1.

Next, a method for using the game system S1 will be described with reference to the accompanying drawings. First, a user requests the relevant management company to issue of a membership card MC. At this time, the user registers (records) in the central management device 2 all sorts of information such as a membership number data individually given to the user and a password data related to the membership number data as well as various data including the user's address, name, telephone number and the like. Further, the membership card MC issued to the user includes an individual membership number and the membership number data identical to those registered in the central management device 2. The user can play games with the pachinko machine 1 (the pachinko box) installed in the station or dining room.

Next, if the user intends to play a game with the pachinko machine 1 of the pachinko box installed in a station, for instance, the user enters the pachinko box and sits on a chair. At this time, the human sensor 19 outputs a detection signal to the main controller 16. Accordingly, the main controller 16 outputs to the display unit 13 a command C that indicates an event of displaying the lending method selection screen 61 shown in FIG. 8. As a result, the display controller 42 of the display unit 13 generates the display image data Dg for displaying the lending method selection screen 61 according to the instruction of the command C and outputs the display image data Dg to the projector unit 51. Then, the projector unit 51 projects the projection light L for displaying the lending method selection screen 61 onto the game board 31 (or screen film 52) on the basis of the outputted display image data Dg. Further, message data to display the lending method selection screen 61 is stored in the image data storage unit 45 along with image data Dp for the display image G.

The aforementioned lending method selection screen 61 displays selection candidates (in this case, two candidates including 'a new play' and 'use of reserved balls') for selecting the new play (a borrowing method in which the lending fee of pachinko balls B is settled by cash, prepaid cards, or credit cards) and a play of using previously stored pachinko balls B (hereinafter, sometimes referred to as "reserved balls") (a method for using the reserved balls obtained in the previous play), and a cursor 60 to select one of the two selection candidates. Further, in the drawing, a lending method selection screen 61 is illustrated with the cursor 60 overlapped the 'use of reserved balls'. However, when the lending method selection screen 61 is firstly displayed, the cursor 60 overlaps the 'new play'. Then, the user operates the handle 15*c* and the selection button 15*a* to select either 'a new play' or 'use of reserved balls'. Specifically, for instance, when the lending fee is settled with cash to borrow pachinko balls B, the selection button 15*a* is operated to overlap the cursor 60 with 'a new play'. At this time, after a predetermined certification process to be described below, the lending fee is settled by any settlement method using cash, prepaid cards, or credit cards. At this time, the lending management unit 11 lends the number of pachinko balls B corresponding to the amount of cash put in by the user.

Figure 9:
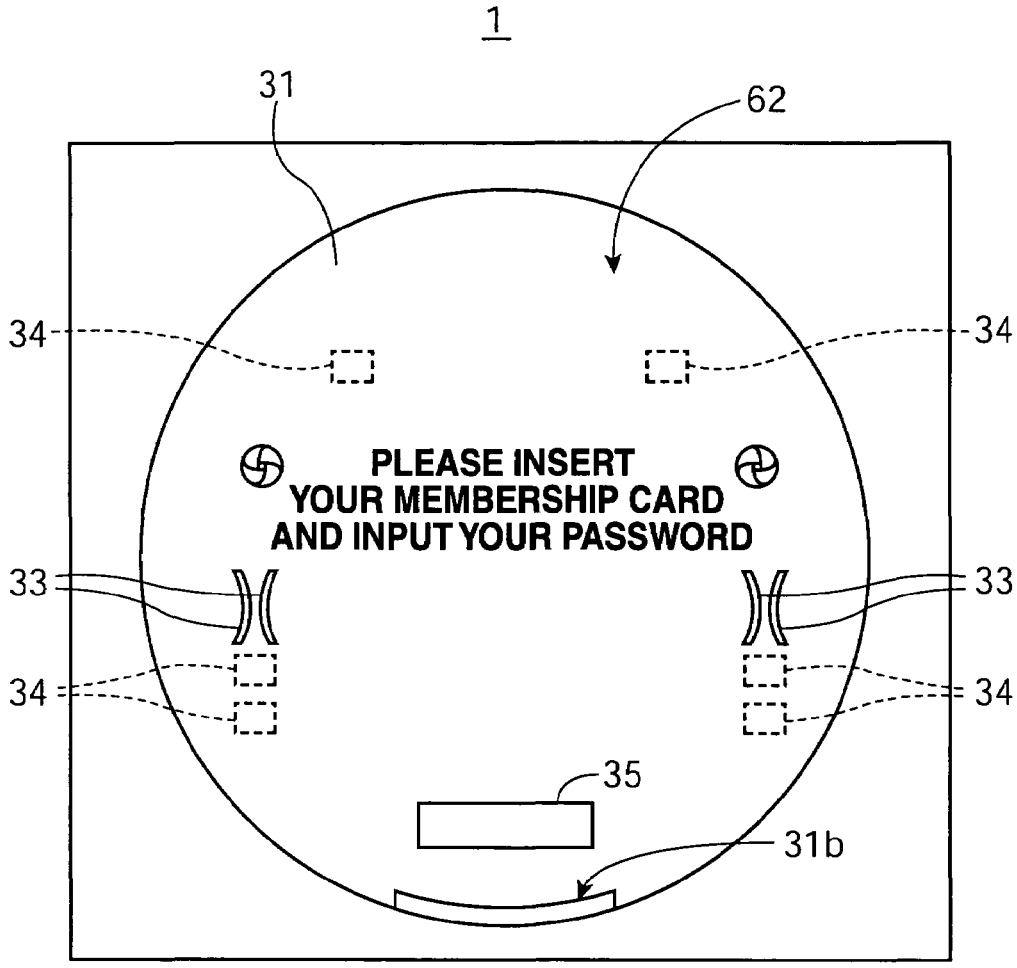
FIG. 9 is a display screen view illustrating an example of a certifying screen 62 displayed on the game board 31 of the pachinko machine 1.

On the other hand, when a play is started by the use of the reserved balls, the user operates the handle 15*c* by turning to the right to overlap the cursor 60 with the 'use of reserved balls' and then operates the selection button 15*a*. When the reserved balls are obtained by the game system S1 prior to the play, the reserved number of balls is recorded in the central management device 2. Therefore, the user may borrow pachinko balls B within the range of the reserved number to play more games. Further, a description will be made about a procedure of recording the reserved number of pachinko balls in the central management device 2. Next, when the 'use of reserved balls' is selected, the certifying screen 62 shown in FIG. 9 is displayed on the game board 31 by the display unit 13 under the control of the main controller 16. At this time, the user inserts his portable membership card MC into the card reader 21 of the lending management unit 11, and manipulates the operation buttons of the operating portion 23 to input the password. Accordingly, the main controller 16 generates the certifying data Dc on the basis of the membership number data read from the membership card MC by the card reader 21 and the password inputted by the user to make the data communication unit 17 transmit the certifying data Dc through the communication network N to the central management device 2.

At this time, the central management device 2 determines whether there exists the reserved number data Db to coincide with the membership number in the certifying data Dc when the certifying data Dc transmitted by the pachinko machine 1 is received. If there exist the reserved number data Db, it is determined whether the password related to the membership number is identical to that in the certifying data Dc. Further, when both passwords are the same, the reserved number data Db related to the membership number of the received certifying data Dc is read and transmitted to the pachinko machine 1 through the communication network N. When there exist no reserved number data Db to coincide with the membership number in the certifying data Dc, or when the two passwords are not the same, the central management device 2 notifies the fact to the pachinko machine 1. At this time, the pachinko machine 1 displays an error message saying that 'Your reserved balls are not registered', and, projects the lending method selection screen 61. On the other hand, when the reserved number data Db is transmitted by the central management device 2, the main controller 16 lends, for instance, one hundred pachinko balls to the lending management unit 11 within the range of the reserved number specified by the reserved number data Db. At this time, the lending management unit 11 makes the conveying mechanism 24 convey one hundred pachinko balls B from the containment section 37 to the ball receiver 36. Further, the main controller 16 makes the kept number display unit 14 display '0000100' to notify that the number (kept number) of pachinko balls B in the ball receiver 36 is one hundred to the user. Further, the kept number displayed in the kept number display unit 14 decreases one by one whenever the ball shooting section 32 shoots a pachinko ball onto the game board 31, but increases by as many pachinko balls as given at the time of 'bingo'.

Figure 10:
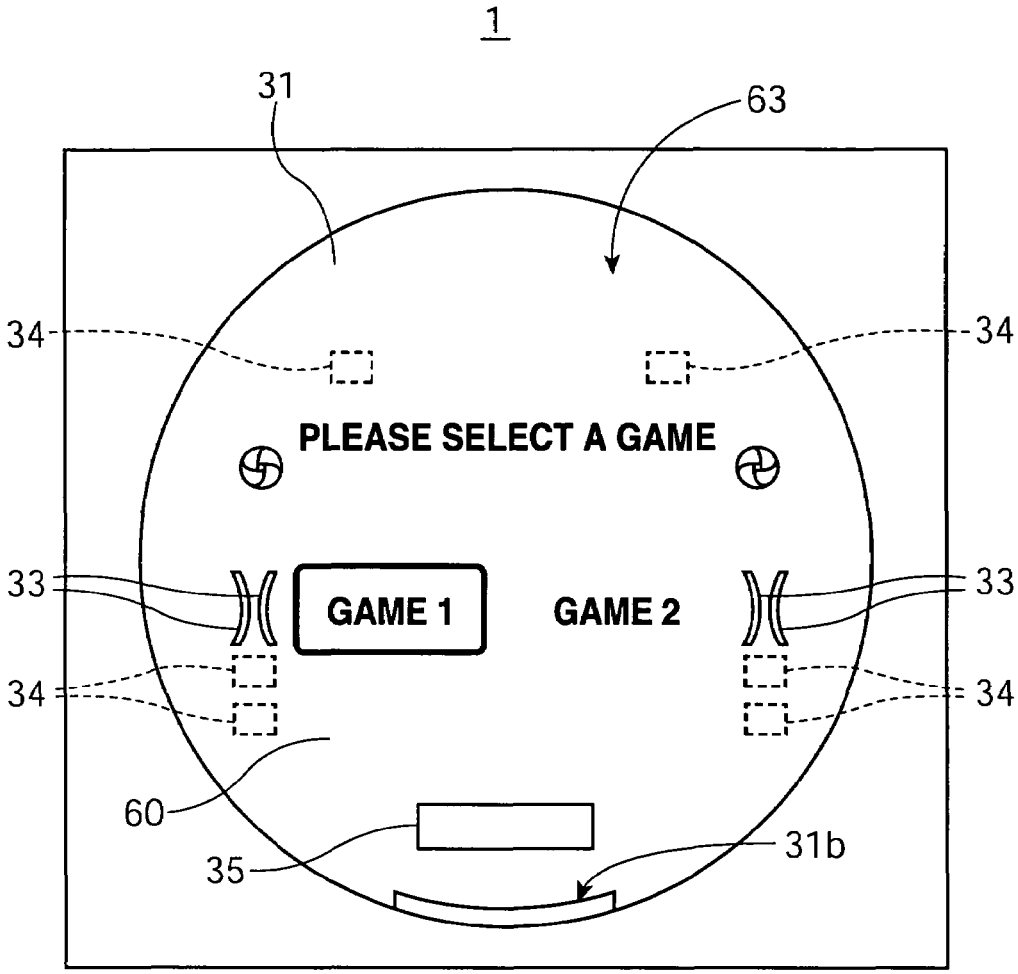
FIG. 10 is a display screen view illustrating an example of a game selection image screen 63 displayed on the game board 31 of the pachinko machine 1.

Next, the main controller 16 outputs a predetermined command C to the display unit 13 to display a game-selecting screen 63 shown in FIG. 10. The game-selecting screen 63 is a screen that allows the user to select one of the two games available to the pachinko machine 1. As shown in the drawing, there are selection candidates 'game 1' and 'game 2', and the cursor 60 to select one of the two candidates. At this time, the selection button 15*a* is manipulated as it is to select 'game 1', or the handle 15*c* is operated to the right (the cursor 60 overlaps 'game 2') and then the selection button 15*a* is operated to select 'game 2'. In this case, when 'game 1' is selected, the main controller 16, as shown in FIG. 3, makes the hit prize sections 34 related to game 1 slide to the protruded state on the basis of the game data stored in the main storage unit 18 and further makes the gauges 33 move (rotate) to the predetermined position. In the drawing, a solid line illustrates the hit prize section 34 that has slid to the protruded position, and a dot line illustrates the recessed state of the hit prize section 34. At the same time, the main controller 16 outputs to the display unit 13 a command C that indicates an event of displaying the display image G (specific information in the present invention) relating to game 1.

Accordingly, the display controller 42 of the display unit 13 reads from the image data storage unit 45 the image data Dp needed to generate display image data Dg for displaying display images G. Next, the display controller 42 draws an image corresponding to the read image data Dp on the virtual plane surface of VRAM 46 (stores the image data Dp) to generate the display image data Dg in the VRAM 46. Subsequently, the display controller 42 outputs the display image data Dg of the VRAM 46 to the projector unit 51 and repeats the image display process until a new command C is inputted. On the other hand, the projector unit 51 projected the projection light L to display the display image G on the basis of the outputted display image data Dg. At this time, the projection light L projected by the projector unit 51 is reflected by the mirror 53 and then transformed into parallel light with Fresnel lens 54. As shown in FIG. 3, the display image G of game 1 overlapped with the game image Gy on the board surface pattern Gb is formed by the screen film 52 into a state of playing a game. Thereafter, the user operates the handle 15*c* to shoot the pachinko balls B out of the ball receiver 36 (actually, the pachinko balls B contained in the containment section 37).

At this time, the pachinko ball B shot out by the ball shooting section 32 falls down on the surface 31*a* of the game board 31, intricately changing its moving or rotating direction by collisions with the nails on the game board 31. In this case, pachinko balls B, which do not pass through 34H but fall down to the lower end of the game board 31, are collected from the collection pocket 31*b* and contained in the containment section 37. On the other hand, when pachinko balls B pass through the hole 34H of the hit prize section 34, the coil 34L detects the passage of the pachinko ball B to output a detection signal S to the main controller 16. In this case, as the coil 34L is arranged along the external circumference of the hole 34H, the pachinko ball B that has passed through the central portion of the coil 34L can be detected for sure. Therefore, it is avoidable to erroneously detect a pachinko ball B that has passed through the periphery of the hit prize section 34 (other than the hole 34H). Further, the pachinko ball B that has passed through the hit prize section 34 falls down to the lower end of the game board 31 and is collected from the collection pocket 31*b*.

On the other hand, when the main controller 16 receives a detected signal S outputted by the hit prize section 34, the main controller 16 makes the conveying mechanism 24 disburse, for example, five pachinko balls B from the containment section 37 to the ball receiver 36, and the main controller 16 makes the display unit 13 output a command C of operating the scroll display of the game image Gy. Accordingly, the display controller 42 outputs the display image data Dg to the projector unit 51 by performing the predetermined image display process. As a result, the projector unit 51 projects the display image G including a game image Gy that shows the state of lot drawing on the basis of the outputted display image data Dg onto the game board 31. At this time, after a certain period corresponding to the display procedure data Ds indicated by the command C elapses, for instance, the figures from 1 to 9 reduce the scrolling speed slowly to stop at the stop pattern indicated by the command C. When the indication is made to stop and display the bingo figure by the command C, the display controller 42 makes a display image G consisting of a firework-firing animation image or a flashing bingo figure (for instance, figure '777') projected and displayed.

Further, when the main controller 16 outputs a command C that indicates an event of making the display unit 13 stop and display the bingo figure, the big winning pocket 35 is opened after a period from the output of the command C has elapsed. At this time, when the pachinko ball B enters the opened big hit prize hole 35 to win a prize, the main controller 16 makes the conveying mechanism 24 disburse the predetermined number of pachinko balls B from the containment section 37 to the ball receiver 36 and also makes the kept number display unit 14 to increase the number of kept pachinko balls (a big prize winning process in the present invention). At this time, when the number of pachinko balls B disbursed into the ball receiver 36 by the conveying mechanism 24 exceeds a predetermined number (for instance, two hundreds), the main controller 16 makes a certain number of pachinko balls greater than one hundred drop to the containment section 37, thereby making it possible to keep the number of pachinko balls B contained in the ball receiver 36 fewer than 100. Further, when the user continues to play games with 10 or fewer pachinko balls B contained in the ball receiver 36 for instance, the main controller 16 makes the conveying mechanism 24 convey, for example, fifty pachinko balls B from the containment section 37 to the ball receiver 36 within the range of the kept number as long as the cancellation button 15*b* is not manipulated.

On the other hand, when the user finishes playing games, the user stops the operation of the handle 15*c* and then operates the cancellation button 15*b*. Accordingly, the main controller 16 calculates the final reserved number of pachinko balls obtained by a user at the time of end of the game on the basis of the kept number (the kept number displayed on the kept number display unit 14) of pachinko balls obtained by a user at the time of operation of the cancellation button 15*b*, the reserved number data Db received from the central management device 2 when the user starts to play the game, and the number of pachinko balls B lent by the lending management unit 11.

Next, the main controller 16 generates the reserved number data Db on the basis of the result of calculation, and relates the generated reserved number data Db to the certifying data Dc transmitted to the central management device 2 when the user starts to play the game, to make the data communication unit 17 transmit them to the central management device 2. At this time, the central management device 2 registers the transmitted reserved number data Db as a new reserved number data Db in relation to the certifying data Dc. As a result, the recordation (registration) of information on the updated reserved number of pachinko balls obtained by the game is completed.

On the other hand, the user who has completed the registration of the reserved number data Db in the central management device 2 can make an exchange with desired prizes within the range of reserved number specified by the reserved number data Db. In this case, in this game system S1, it is possible to select one of the two exchange methods, either going to the prize exchange office and making an exchange for prizes or performing the prize exchange process by accessing to the web site of the web server 4 with the Internet-accessible terminal for the delivery of a desired prize.

For instance, when the prize is exchanged in the prize exchange office, the user goes to the prize exchange facility 3 and presents the user's membership card MC. Next, a clerk in charge lets the card reader read the membership number data from the membership card MC and lets the user input his/her password. At this time, the managing terminal 3*a* generates the certifying data Dc on the basis of the membership number data read from the membership card MC and the inputted password, and transmits the certifying data Dc through the communication network N to the central management device 2. Next, the central management device 2 determines whether there exist the reserved number data Db to coincide with the membership number in the certifying data Dc when the certifying data Dc transmitted by the managing terminal 3*a* is received. If there exist the reserved number data Db, it is determined whether the password related to the membership number is identical to that of the certifying data Dc. Further, when both passwords are the same, the reserved number data Db related to the membership number in the received certifying data Dc is read and transmitted to the managing terminal 3*a* through the communication network N. Accordingly, the managing terminal 3*a* displays the reserved number registered in relation to the user (membership number) on the display unit. Then, the user requests the exchange with a desired prize within the range of the reserved number, and then he/she is awarded the desired prize. Further, when the clerk in charge of the prize exchange office inputs the reserved number used for exchange with the prize, the managing terminal 3*a* generates a new reserved number data Db on the basis of the reserved number data Db transmitted by the central management device 2 and the inputted reserved number (the reserved number used for exchange with prizes), and relates the new reserved number data Db to the certifying data Dc, to transmit it to the central management device 2. As a result, reserved number data Db on the new reserved number reduced by the reserved number used for exchange with the prize is registered in the central management device 2.

On the other hand, when the prize exchange process is performed by an Internet-accessible terminal (a personal computer 5*a*), the user makes access to the web server 4 (digital contents of the web site operated by the management company) by the personal computer 5*a* through the Internet. Next, the user manipulates to input the individually given membership number and password. At this time, the personal computer 5*a* generates the certifying data Dc on the basis of the inputted membership number and password to transmit them to the web server 4. Accordingly, the web server 4 determines whether there exist the reserved number data Db to coincide with the membership number in the certifying data Dc on the basis of the certifying data Dc transmitted by the personal computer 5*a*. If there exist the reserved number data Db to coincide with the membership number, it is determined whether the password in the certifying data Dc related to the reserved number data Db is identical to the password transmitted by the personal computer 5*a*. When there exist the reserved number data Db relating to the membership number and when both passwords are the same, the reserved number data Db is transmitted to the personal computer 5*a*. As a result, the reserved number obtained by the user is displayed on the display unit of the personal computer 5*a*.

Next, the user operates to select a prize to be capable of being exchanged within the range of the reserved number obtained by the user. At this time, the web server 4 determines whether the prize selected by the user can be exchanged within the range of the reserved number acquired by the user. When it is determined that the prize can be exchanged, the web server 4 generates a new reserved number data Db that has been reduced by the reserved number required for exchange with the prize to transmit it to both the personal computer 5*a* and the central management device 2. Further, the web server 4 performs a process of delivering the selected prize to the user (for instance, additional writing of the delivery list information). Accordingly, the personal computer 5*a* displays a message indicating the completion of the prize exchange process and a new reserved number reduced by the reserved number used for exchange with the prize. Further, a reserved number data Db corresponding to the new reserved number reduced by the reserved number for exchange with the prize is registered in relation to the certifying data Dc in the central management device 2.

Likewise, according to the aforementioned pachinko machine 1, the main controller 16 makes the data communication unit 17 record the reserved number data Db readably in the central management device 2. Further, the main controller 16 performs either the settlement lending processing or the reservation lending processing along with the lending management unit 11. The game mechanism 12 is constructed to supply the pachinko balls B collected from the collection pocket 31*b* and contained in the ball receiver 36 to the ball shooting section 32 for the cyclic use of a predetermined number of pachinko balls, so that a game can be played without necessitating the ball conveying device for conveying pachinko balls B to the pachinko machine or a ball lending device, or the ball counter for counting obtained pachinko balls. Therefore, the pachinko machine can be installed in station premises or dining rooms to thereby provide a pachinko player a new opportunity or environment in which player can play pachinko games conveniently at any time. In this case, in contrast to the game played with a virtual pachinko machine, for instance, a game played with a virtual mechanism virtually displayed on the display unit, in the pachinko machine 1 related to the present invention, a game using an actual pachinko machine 1, in which pachinko balls B fall down on the game board 31, is played, so that a favorable game can be provided for the pachinko players.

Further, according to the aforementioned pachinko machine 1, a top opening of the pachinko ball receiver 36 is covered with a transparent glass plate 36*a*, and the ball conveying mechanism 24 of the lending management unit 11 supplies the lent pachinko balls B to the pachinko ball receiver 36. Therefore, it is possible to avoid any possibility of losing the pachinko balls as in the case that the user carries the pachinko balls away with him, while the user can see the disbursed pachinko balls B.

Further, according to the aforementioned pachinko machine 1, when either game is selected through the selecting operation, the main controller 16 outputs a predetermined command C to the display unit 13, which specifies the display procedure data Ds in accordance with the outputted command C to display a display image G. Therefore, two kinds of games can be enjoyed with one pachinko machine 1 without the installation of a plurality of pachinko machines for different kinds of games. Further, in contrast to the conventional pachinko machine, other kinds of games can also be started swiftly and easily. Thus, a player can enjoy two kinds of games easily.

Moreover, according to the aforementioned pachinko machine 1, the display controller 42 can project a board surface pattern Gb of a selected game or a game image Gy to the projector unit 51 to display it in accordance with the command C. For instance, in contrast to the image display unit consisting of an LCD panel or a CRT, board surface patterns can be changed in accordance with the changed kinds of game. Therefore, in comparison with the change to be made only in the game images displayed on an LCD panel, a CRT or the like, a much more favorable display image can be displayed.

Moreover, according to the aforementioned pachinko machine 1, a hit prize section 34 is provided with the hole 34H formed to pass the pachinko ball B that has fallen on the surface 31*a* of the game board 31 and a coil 34L to output a detection signal S when the pachinko ball B has passed through the hole 34H. Thus, all the pachinko balls B (except those that have entered the big hit prize hole 35) shot out by the shooting section 32 can be collected from the pachinko ball collection pocket 31*b*. As a result, a mechanism for collecting pachinko balls B can be constructed simply and easily, which makes it possible to construct the pachinko machine 1 more easily than the pachinko machine having a hit prize section that collects pachinko balls B to the back side of the game board 31. Further, in the pachinko machine for collecting pachinko balls B at the back side of the game board 31, a tube that moves the collected pachinko balls B to the containment section 37 may deter the projection display of display images G by the projector unit 51 (due to the shadow of the tube). In contrast, the hit prize section 34 of the present invention, no tube is needed to project display images G easily with no shadow of the tube as such.

Further, according to the aforementioned pachinko machine 1, one of the hit prize sections 34 is slid to the protruded position in accordance with the game selected by the main controller 16 and the other hit prize sections 34 are slid to the recessed positions. Therefore, in comparison with a pachinko machine (a pachinko machine in which a hit prize section 34 is fixed to a game board 31 in its protruded state) where only a board surface pattern Gb or game image Gy is changed, much more favorable games can be provided due to the greater changes.

Moreover, according to the aforementioned pachinko machine 1, the main controller 16 moves the gauges 33 in accordance with the selected game. Therefore, in comparison with a pachinko machine 1 (a pachinko machine 1 in which gauges 33 is fixed to a game board 31 without a movement) where only a board surface pattern Gb or game image Gy is changed, much more favorable games can be provided due to the greater changes.

Further, according to the aforementioned pachinko machine 1, the lending management unit 11 (main controller 16) performs the settlement lending processing to receive the lending fee by using any method such as cash, prepaid cards, or substitute settlement means (for instance, credit cards) as a predetermined settlement method. For instance, if a prepaid card is not held, the pachinko balls B can be borrowed in cash. If cash is not held, the prepaid card is used to borrow pachinko balls B to play games.

Moreover, according to the aforementioned pachinko machine 1 and game system S1, the main controller 16 makes the data communication unit 17 record the reserved number data Db readably in the central management device 2 through the communication network N, thereby making it possible to avoid intentionally changing the reserved number data Db. When a game is played by a plurality of scattered pachinko machines, the pachinko balls B can be borrowed within the range of the reserved number specified by the reserved number data Db recorded in the central management device 2.

Further, according to the aforementioned game system S1, a managing terminal 3*a* or a personal computer 5*a* are provided to read (receive) the reserved number data Db from the central management device 2, to perform a prize exchange process within the range of the reserved number specified by the read-out reserved number data Db, and to record in the central management device 2 a new reserved number data Db reduced by the reserved number corresponding to the exchanged prize. Just like in the game played in the conventional pachinko machine, it is possible to make an exchange for a desired prize within the range of the reserved number of pachinko balls. In this case, according to the aforementioned game system S1, in contrast to the prize exchange in the conventional pachinko shop, it is not necessary to contain the ejected pachinko balls in the ball box and carry them to the counter, thereby reducing the user's inconvenience.

Moreover, according to the aforementioned game system 1, the pachinko machine 1 is installed in a movable pachinko box in which air-conditioning installation, illumination equipment and a sound facility are installed therein so that a user is allowed to enter. Further, the pachinko box is constructed with the pachinko machine 1, the air-conditioning facility and the illumination equipment to be movable to another installation place. Therefore, the pachinko box can be easily installed in any place like station premises or dining rooms. Further, in comparison with installing the pachinko machine 1 in the station premise as it is, the game system S1 makes it possible to provide an environment where a user can better concentrate on a pachinko game.

Next, another embodiment of the game system S2 of the present invention will be described with reference to the drawings. Further, the present invention is basically applied to the game system S2 similar to the game system S1. Therefore, the same reference numerals are given to the parts of the game system S2 similar to those of the game system S1 and repeated description thereof will be omitted. Further, coins (medals) are used in the game system 2 to play a game, instead of the pachinko balls B in the game system S1. Thus, in the game system S2, various data relating to the coins will be used instead of the data (for instance, the reserved number data Db) relating to the pachinko balls B.

Figure 12:
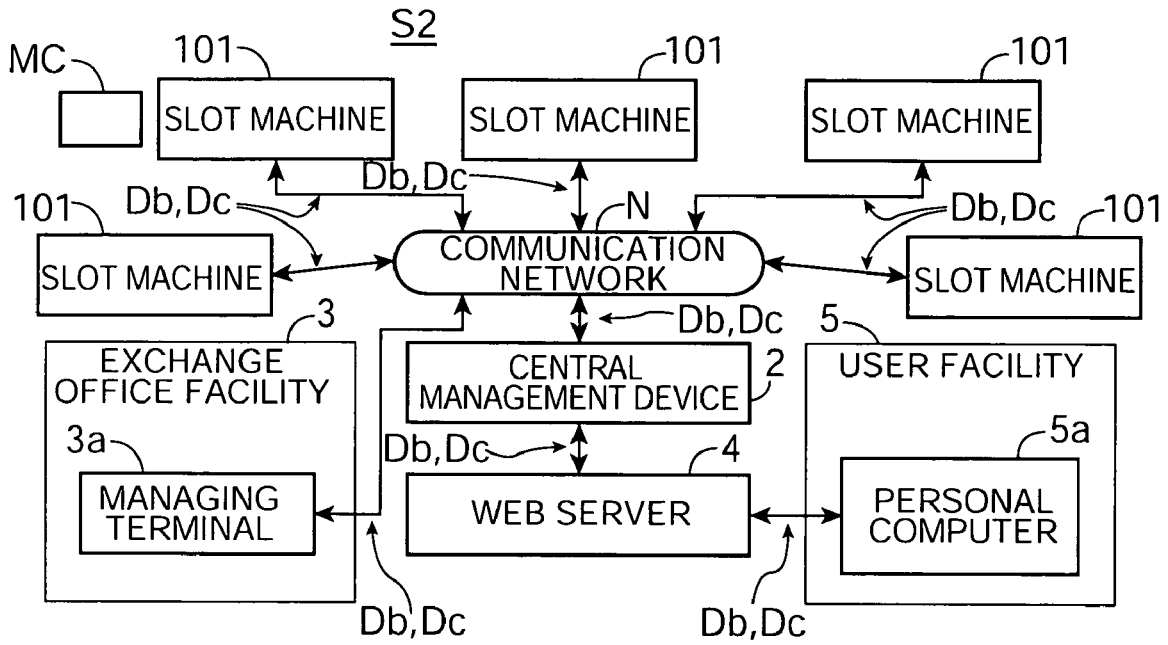
FIG. 12 is a block diagram illustrating the construction of a game system S2.

As shown in FIG. 12, the game system S2 comprises a plurality of slot machines (game machines) 101, a central management device 2, an exchange office facility 3, a web server 4 and a user facility 5. In this case, the slot machine 101 is constructed similar to the pachinko box in the game system S1 and is installed in a slot machine box (box in the present invention, not shown) to be installed at any place like station premises, dining rooms, or department stores.

Figure 13:
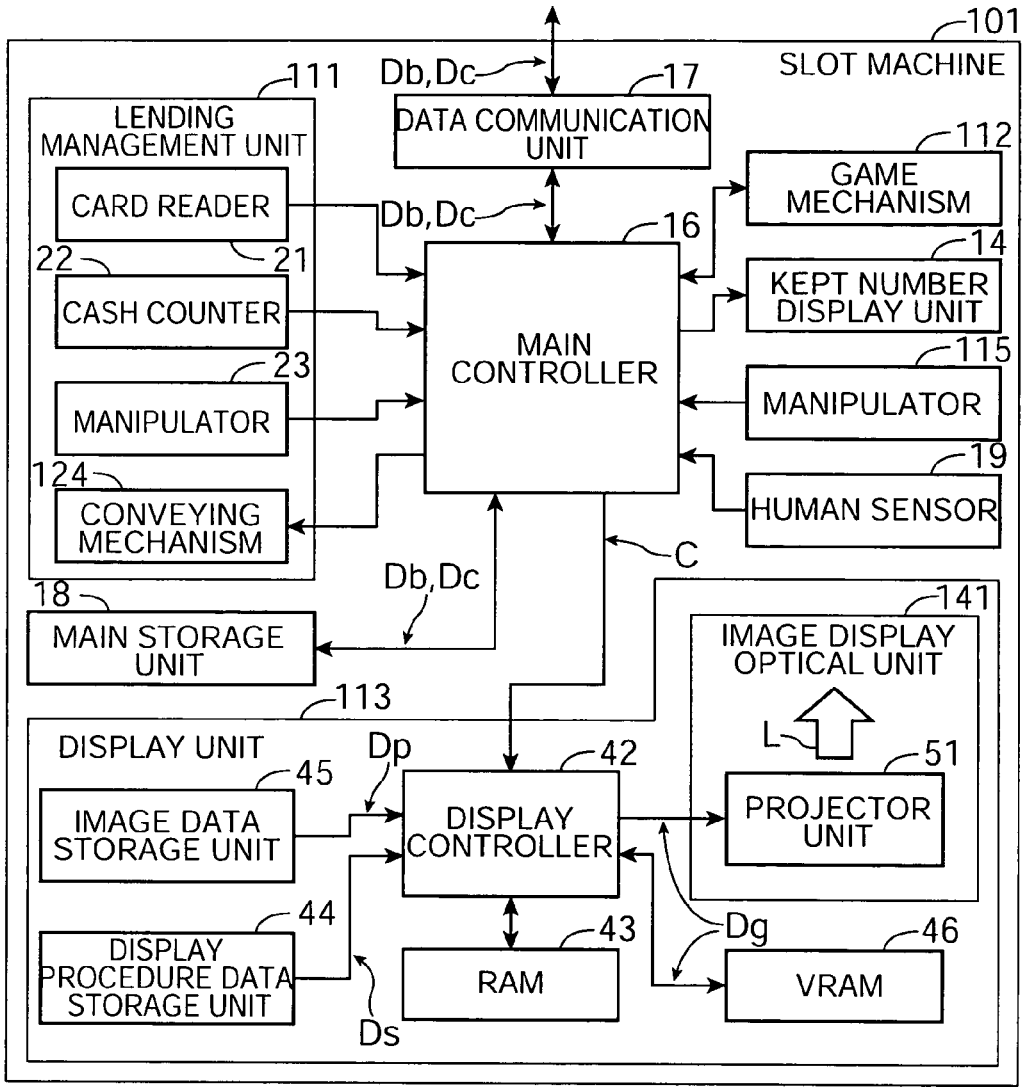
FIG. 13 is a block diagram illustrating the construction of a slot machine 101.
Figure 14:
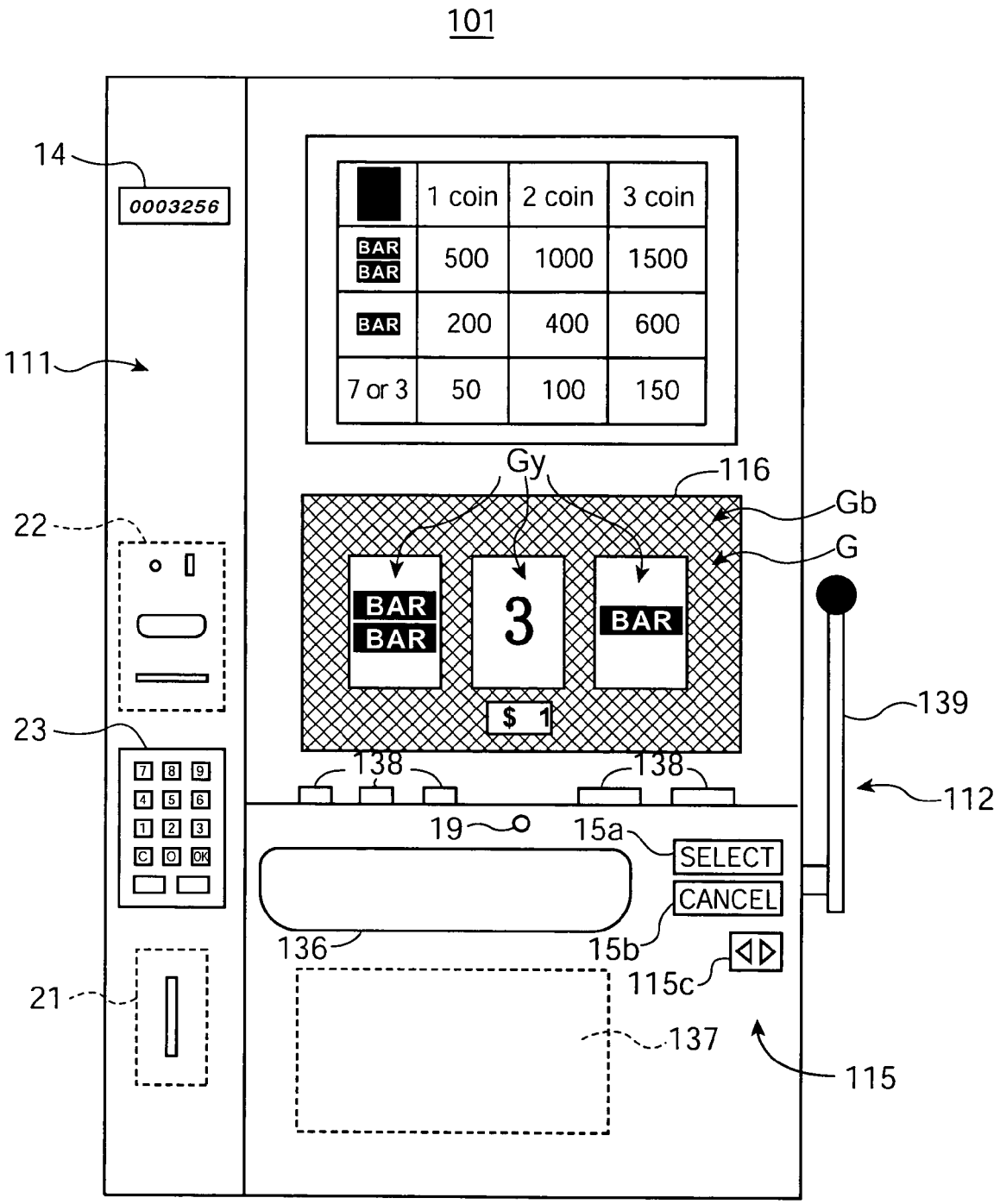
FIG. 14 is a front view illustrating the schematic construction of the slot machine 101.

Specifically, as shown in FIG. 13, the slot machine 101 comprises a lending management unit 111, a game mechanism 112, a display unit 113, a kept number display unit 14, a manipulator 115, a main controller 16, a data communication unit 17, a main storage unit 18, and a human body sensor 19. As shown in FIG. 14, in the slot machine 101, the projection light L (refer to FIG. 15) is projected to the back side of the display panel (image display board) 116 arranged in the front side of the machine main body, thereby making it possible to display the display images G (for instance, a board surface pattern Gb shaped in the form of a stitches and a game image Gy imitating a reel as shown in FIG. 14).

As shown in FIG. 13, the lending management unit 111 includes a card reader 21, a cash counter 22, a operating portion 23 and a conveying mechanism 124, and it is arranged at the left end of the slot machine 101. In this case, the card reader 21 is constructed to be capable of reading various information from a membership card MC (refer to FIG. 12) having an individually given membership number of a user of the game system S2 or from a credit card. The conveying mechanism 124 conveys a predetermined number of coins from a containment section 137 (refer to FIG. 14) to eject them to a coin receiver 136 (refer to FIG. 14) when the main controller 16 has allowed lending of the coins.

Figure 15:
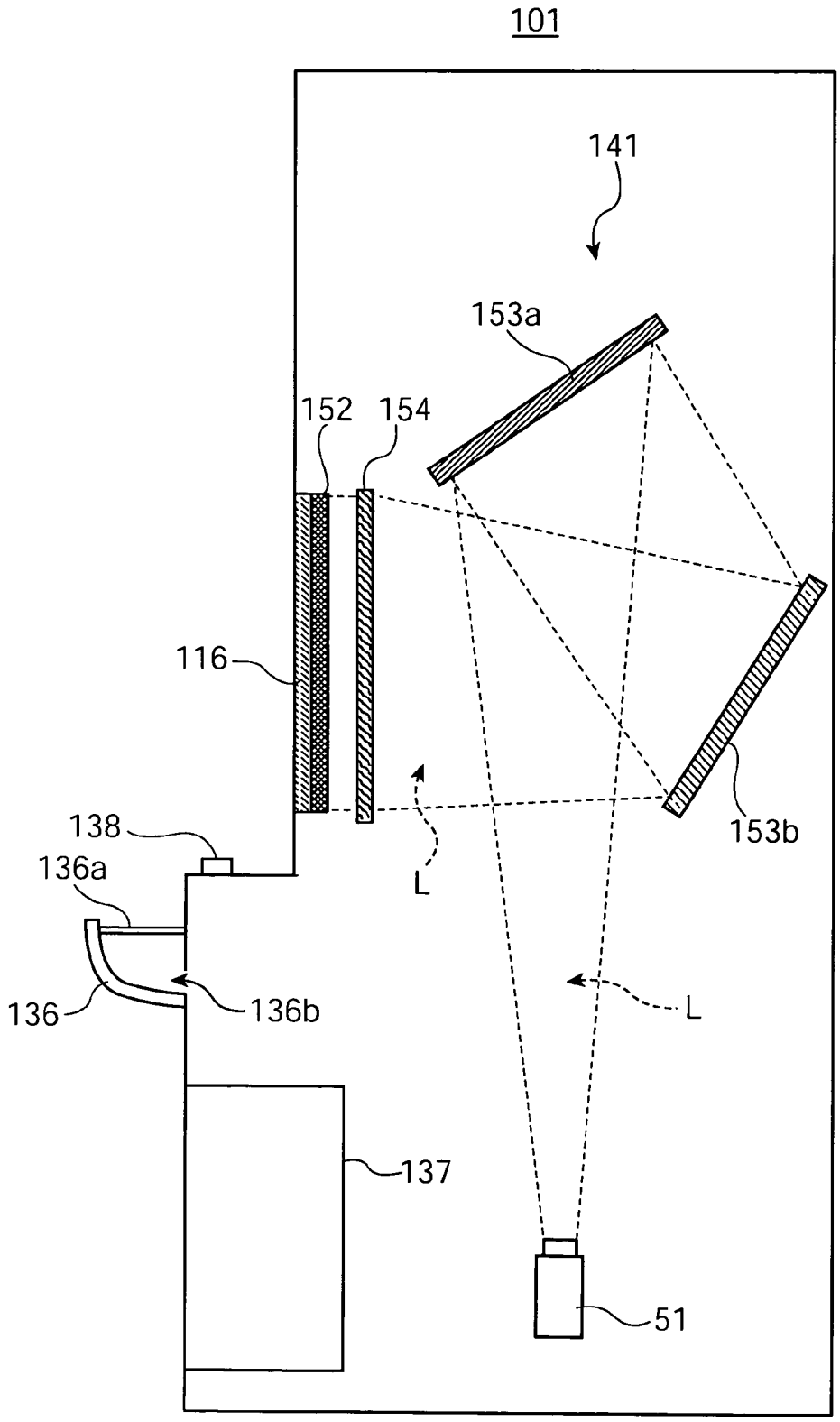
FIG. 15 is a lateral cross-section view illustrating the schematic construction of the slot machine 101.

As shown in FIG. 14, the game mechanism 112 comprises a coin receiver 136, a containment section 137, operation buttons 138, and a handle 139. As shown in FIG. 15, the coin receiver 136 is constructed to receive a plurality of coins, and a top opening of the coin receiver 136 is covered with a transparent glass plate 136*a* (a transparent material in the present invention). The coins lent by the lending management unit 111 are discharged to the coin receiver 136, and a predetermined number of coins are disbursed to the coin receiver 136 when a 'bingo' is hit by lot drawing. The containment section 137 is arranged in the main body of the slot machine 101 to make the coins put in the coin input hole 136*b* and the coins in the coin receiver 136 fall, and to contain a predetermined number of coins. In this case, a plurality of coins are cyclically utilized in the slot machine 101. Specifically, when a player operates an operation button 138 for inserting coins in the slot machine 101, a predetermined number of coins (for instance, 3 coins) contained in the coin receiver 136 are taken by the conveying mechanism 124 out of the input hole 136*b* (refer to FIG. 15) formed near the bottom of the coin receiver 136 in the front panel of the machine main body to fall to the containment section 137 (put coins into the input hole 136*b*). Further, in the slot machine 101, when coins are disbursed, a predetermined number of coins are conveyed and discharged from the containment section 137 to the coin receiver 136 by the conveying mechanism 124.

As shown in FIG. 13, the display unit 113 comprises an image display optical unit 141, a display controller 42, RAM 43, a display procedure data storage unit 44, an image data storage unit 45, and VRAM 46. As shown in FIG. 15, the image display optical unit 141 comprises a screen film 152 adhered to the back side of the display panel 116, mirrors 153*a*, 153*b*, Fresnel lens 154, and a projector unit 51. As shown in FIG. 14, the manipulator 115 comprises a selection button 15*a*, a cancellation button 15*b*, and a lending method selection screen 161 displayed on the display panel 116 shown in FIG. 16 or a movement button 115*c* to operate the movement of the cursor 160 on a game-selecting screen 163 shown in FIG. 18.

Figure 16:
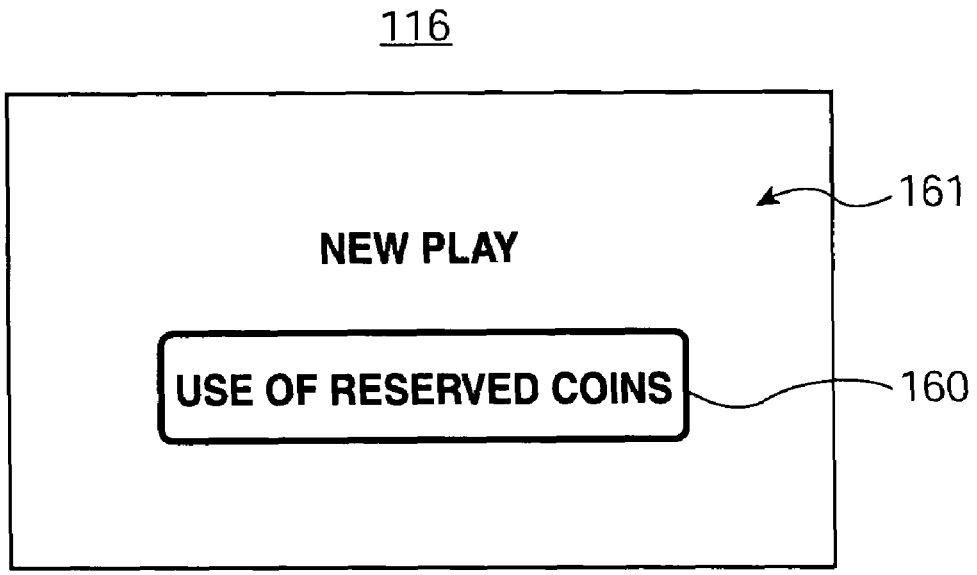
FIG. 16 is a display screen view illustrating an example of a lending method selection screen 161 displayed on the display panel 116 of the slot machine 101.

When a user gets in the slot machine box of the game system S2 installed in a station premise and sits on a chair installed in the front side of the slot machine 101, a detection signal is outputted by the human sensor 19 and thereby the main controller 16 outputs to the display unit 113 a command C that indicates an event of displaying the lending method selection screen 161 shown in FIG. 16. Then, the display controller 42 of the display unit 113 generates the display image data Dg for displaying the lending method selection screen 161 in accordance with the instruction of the command C and outputs the display image data Dg to the projector unit 51. Then, the projector unit 51 projects the projection light L based on the display image data Dg, thereby making it possible to display the lending method selection display 161 on the display panel 116 as shown in FIG. 16.

Figure 17:
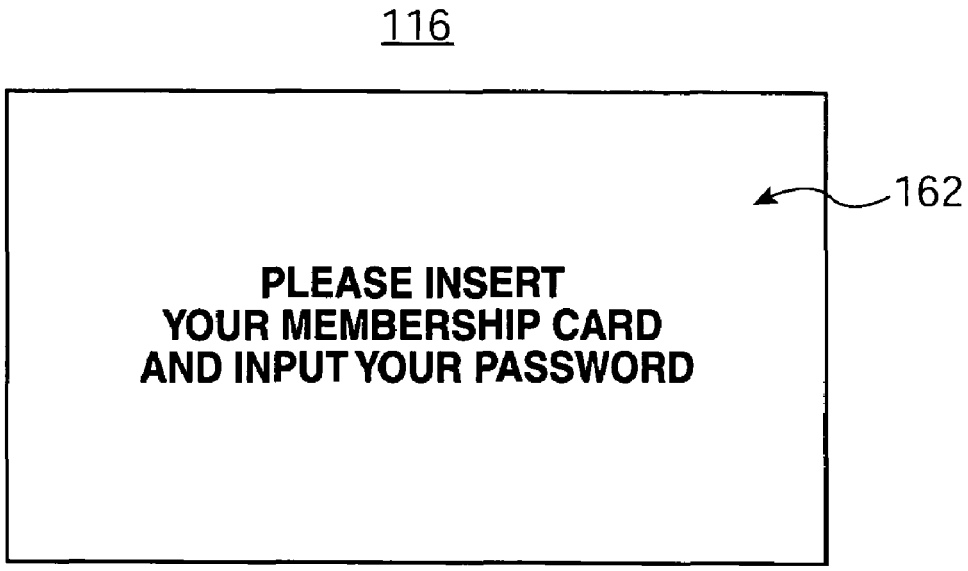
FIG. 17 is a display screen view illustrating an example of a certifying screen 162 displayed on the display panel 116 of the slot machine 101.

In this case, the aforementioned lending method selection screen 161 displays selection candidates (in this case, two candidates including 'a new play' and 'use of reserved coins') for selecting either the new play or the play (a method using the reserved coins obtained in the games prior to this game) of using previously stored coins (hereinafter, sometimes referred to as 'reserved coins'), and a cursor 160 to select one of the two candidates. Then, the player operates the movement button 115*c* and the selection button 15*a* to move the cursor 160 on the lending method selection screen 161. Specifically, for instance, when the 'use of reserved coins' is selected, the certifying screen 162 shown in FIG. 17 is projected to the display panel 116 and displayed thereon by the display unit 113 under the control of the main controller 16.

Subsequently, similar to the procedure of the game system S1, when the user inserts the membership card MC into the card reader 21 and inputs the password, the main controller 16 and the central management device 2 perform the certification process by combination of the passwords. Next, if both passwords are the same, the main controller 16 makes the lending management unit 111 lend a predetermined number of coins to the user within the range of the reserved number. At this time, the lending management unit 111 makes the conveying mechanism 124 convey and discharge, for instance, one hundred coins from the containment section 137 to the coin receiver 136. Further, the main controller 16 makes the kept number display unit 14 display '0000100' to notify to the user that the number (kept number) of coins contained in the coin receiver 136. Further, the kept number displayed in the kept number display unit 14 decreases whenever coins are conveyed by the conveying mechanism 124 and inserted into the coin input slot 136*b*, but increases by as many coins as disbursed at the time of 'bingo'.

Figure 18:
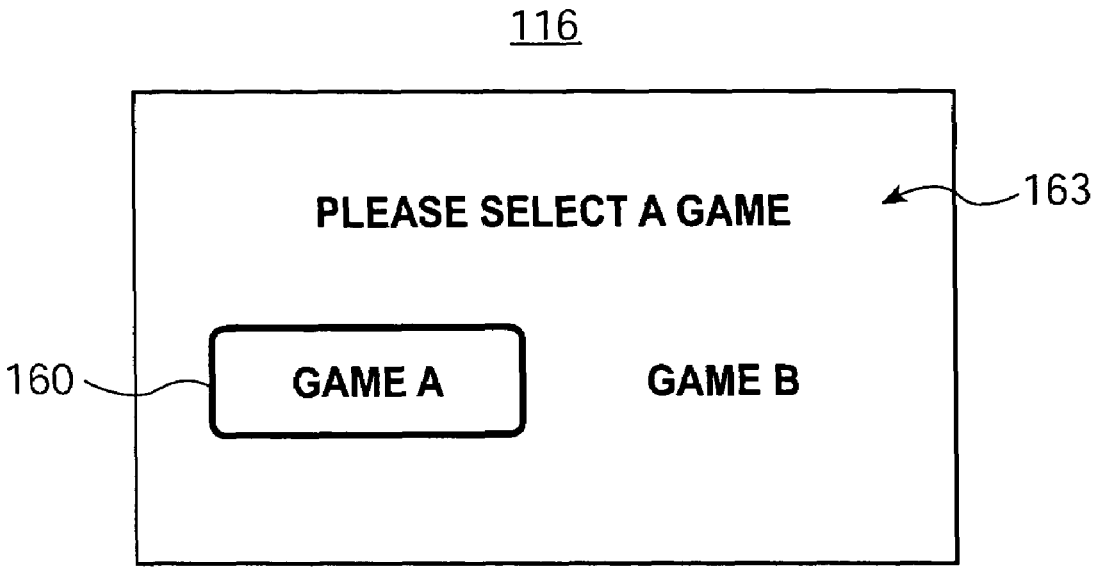
FIG. 18 is a display screen view illustrating an example of a game selection image screen 163 displayed on the display panel 116 of the slot machine 101.

Next, the main controller 16 outputs a predetermined command C to the display unit 113 to display a game-selecting screen 163 shown in FIG. 18. The game-selecting screen 163 is a screen that allows the user to select one of the two games available to the slot machine 101. As shown in the drawing, the game-selecting screen 163 displays selection candidates 'game A' and 'game B', and the cursor 160 to select one of the two candidates. For instance, when "game A" is selected by the operation of the selection button 15*a* and the movement button 115*c*, the main controller 16 outputs to the display unit 113 a command C that indicates an event of displaying the display image G relating to "game A".

Accordingly, the display controller 42 of the display unit 113 performs the image display process to output the display image data Dg, and the projector unit 51 projects the projection light L based on the outputted display image data Dg. At this time, the projection light L projected by the projector unit 51 is reflected by the mirrors 153*a*, 153*b*, transformed into parallel light by Fresnel lens 154, and projected to the screen film 152, as shown in FIG. 15. Accordingly, a display image G for 'game A' overlapping the game image Gy over the board surface pattern Gb is formed by the screen film 152, resulting in a state of a slot machine ready for a game.

Next, when the user manipulates the coin input operation button 138, the conveying mechanism 124 puts, for instance, three coins contained in the coin receiver 136 from the input hole 136*b*. At this time, the inputted coins fall down to the containment section 137 to be contained in the containment section 137. Subsequently, when the user operates the handle 139, the main controller 16 makes lot drawing and outputs a command C to make the display unit 113 display the display image G including the scroll-reel imitating game image Gy. Accordingly, the display controller 42 outputs the display image data Dg, and makes the projector unit 51 project a display image G including the game image Gy that indicates the drawing state to the display panel 116, to display it thereon.

At this time, when a 'bingo' is hit by the lot drawing, the main controller 16 outputs a command C that indicates an event of displaying the display image G including the game image Gy for the 'bingo'. In this case, the game image Gy for the 'bingo' includes, for example, an image that imitates a reel to stop three consecutive identical patterns (for instance, BAR/BAR) side by side, as the scrolling speed decreases slowly. Then, the main controller 16 makes the conveying mechanism 124 disburse a predetermined number of coins from the containment section 137 to the coin receiver 136 and also makes the kept number display unit 14 increase the number of kept coins.

On the other hand, when the user finishes playing games, the user operates the cancellation button 15*b*. Then, the main controller 16 calculates the final reserved number of coins obtained when the game is finished by the user on the basis of the number of kept coins obtained by the user (the kept number displayed on the kept number display unit 14), the reserved number data Db received from the central management device when the user starts to play the game, and the number of coins lent by the lending management unit 111. Then, the main controller 16 generates the reserved number data Db on the basis of the result of calculation, relates the reserved number data Db to the certifying data Dc transmitted to the central management device 2 when the user starts to play the game, and then makes the data communication unit 17 transmit it to the central management device 2. At this time, the central management device 2 registers the transmitted reserved number data Db as a new reserved number data Db in relation to the certifying data Dc. As a result, the recordation (registration) of information on the updated reserved number of coins is completed, including coins obtained by the game.

Further, the game system S2, similar to the game system S1, also allows the user to make an exchange for desired prizes within the range of reserved number specified by the reserved number data Db in two kinds of prize exchange method. In this case, for instance, if the user is a member for both game systems S1, S2, it is possible to make an exchange with desired prizes within the range of total reserved number of pachinko balls and coins obtained in both game systems S1 and S2.

Likewise, in the slot machine 101, the main controller 16 makes the data communication unit 17 record the reserved number data Db in the central management device 2 readably, and performs either the settlement lending processing or reservation lending processing along with the lending management unit 111. The game mechanism 112 is constructed to cyclically use a predetermined number of coins including the coins inserted into the input hole 136*b* and the coins contained in the coin receiver 136, so that there may be no need for facilities such as the coin conveying device for conveying coins to the slot machine or the coin lending device or the coin counter for counting obtained coins. Therefore, the slot machine can be installed in station premises or dining rooms to thereby provide the players with a new opportunity or environment for playing games conveniently at any time. In this case, in contrast to the game played with a virtual slot machine, for instance, a game played with a display unit displaying as many as the obtained coins, a game using an actual slot machine, in which actual coins are disbursed to the coin receiver 136, is played, a favorable game can be provided for the players.

Further, a top opening of the coin receiver 136 is covered with a glass plate 136*a*, and the conveying mechanism 124 performs the supply of the lent coins to the coin receiver 136, the insertion of the coins in the coin receiver 136 into the input hole 136*b*, and the disbursement of coins to the coin receiver 136. Therefore, it is possible to avoid any possibility of losing the coins due to a user carrying the coins away with him, while the user can see the disbursed coins. When either game is selected by the user's operation, the main controller 16 outputs a predetermined command C to the display unit 113, which specifies the display procedure data Ds in accordance with the outputted command C to display a display image G. Therefore, a plurality of games (for instance, two kinds of games) can be enjoyed with one slot machine 101 without the installation of a plurality of slot machines for different kinds of games. By simply selecting one of two kinds of games manually, the game can also be started swiftly and easily. Thus, a player can enjoy two kinds of games with ease.

Further, the display controller 42 makes the projector unit 51 project the board surface pattern Gb and the game image Gy for the selected game in accordance with the command C, so that it is possible to make various changes in the board surface patterns of the display panel 116 in accordance with the changes in the game (for instance, reel patterns). Further, the lending management unit 111 (the main controller 16) performs the settlement lending processing by using any settlement method such as cash, prepaid cards or substitute settlement means. For instance, if a prepaid card is not held, the coins can be borrowed in cash. If cash is not held, the prepaid card is used to borrow the coins to play games.

Moreover, according to the aforementioned slot machine 101 and game system S2, the main controller 16 makes the data communication unit 17 record the reserved number data Db readably in the central management device 2 through the communication network N, thereby making it possible to avoid intentionally changing the reserved number data Db. When a game is played by a plurality of slot machines 101 scattered, the coins can be borrowed within the range of the reserved number specified by the reserved number data Db recorded in the central management device 2 to play games.

Further, according to the aforementioned game system S2, a managing terminal 3*a* or a personal computer 5*a* are provided to read (receive) the reserved number data Db from the central management device 2, to perform a prize exchange process within the range of the reserved number specified by the read-out reserved number data Db, and to record in the central management device 2 the new reserved number data Db reduced by the reserved number corresponding to the exchanged prize. Thus, similar to the game played with the pachinko machine 1 in the conventional game system S1, it is possible to make an exchange with a desired prize within the range of the obtained reserved number of coins.

Moreover, the slot machine 101 is installed in a movable slot machine box in which air-conditioning installation, illumination equipment and a sound facility are installed therein so that a user is allowed to enter. Further, the slot machine box is constructed to be movable to another installation place with the slot machine 101, the air-conditioning facility, and the illumination equipment therein. Therefore, the slot machine 101 can be easily installed at any place like station premises or dining rooms. Further, in comparison with the installation of the slot machine 101 in the station premise, the game system S2 makes it possible to provide an environment where a user can better concentrate on a pachinko game.

Further, the scope of the present invention is not limited to the aforementioned preferred embodiments of the present invention. For instance, in the embodiments of the present invention described above, the reserved number data Db is recorded in the central management device 2 through communication network N. However, the scope of the invention is not limited thereto, a card reader/writer is arranged in the pachinko machine (or slot machine) and the reserved number data Db or certifying data Dc can be readably recorded in a removable media like a card type memory medium (for instance, a magnetic card or an IC card) through the card reader/writer. In this case, when the aforementioned construction is made to record the reserved number data Db in the removable media, the prize exchange process can be performed with the reserved number data Db read by the managing terminal 3*a* from the removable media. According to this construction, the central management device 2 may not be needed to thereby construct the game system S1 (or game system S2) at low cost. However, in contrast to the game system S1 (or game system S2), the card reader needs to be connected to a personal computer 5*a* to perform the prize exchange process using the personal computer 5*a* of the user facility 5. Further, in the case that the aforementioned construction is applied to the game system, there may be a possibility of intentionally making a change in the reserved number data Db of the removable media.

Therefore, it is preferable that the reserved number data Db be registered in the removable media, the reserved number data Db identical to the reserved number data Db registered in the removable media be recorded in the central management device 2, and the identity between the reserved number data Db registered in the removable media and the reserved number data Db of the central management device 2 be established.

Further, in the preferred embodiments of the present invention, the central management device 2 performs the certification process on the basis of the certifying data Dc transmitted by the pachinko machine 1 (or the slot machine 101) at the time of lending of pachinko balls B (or coins) or the prize exchange. However, the scope of the present invention is not limited thereto, the construction can be made to perform the certification process in the pachinko machine 1 (or the slot machine 101). Specifically, the main controller 16 determines whether the password inputted from the manipulator 23 is identical to that in the certifying data Dc read (transmitted) from the central management device 2. When both passwords are identical, the construction is made to let the lending management unit 11 (or the lending management unit 111) allow the lending of pachinko balls B (or coins). Similar to the aforementioned game system S1 (or game system S2), this construction can reliably prevent a finder of the membership card MC from borrowing the pachinko balls B (or coins) or making an exchange with prizes. Further, in the preferred embodiments of the present invention, cash, a prepaid card or a credit card is used to be able to settle the lending fee of the pachinko balls B (or coins), but the scope of the invention is not limited thereto. For instance, a construction may be employed such that the pachinko machine (or the slot machine) makes an access to a cellular phone to thereby specify a specific telephone number thereof, and thereafter the lending fee of the pachinko balls B (or coins) is settled along with the phone bill of the cellular phone having the specific telephone number.

Figure 11:
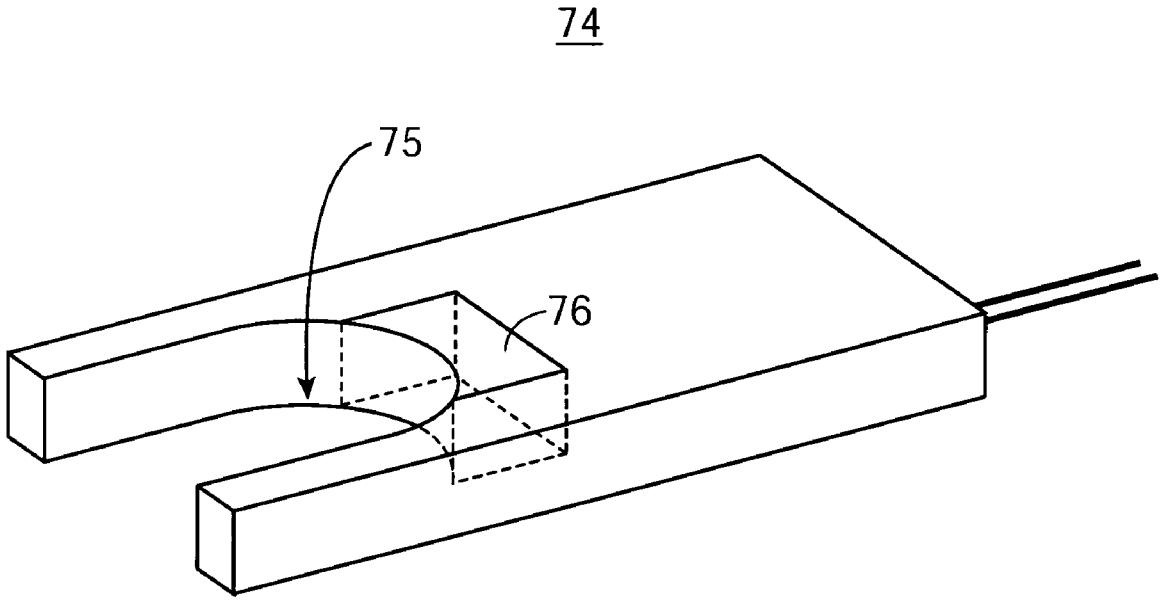
FIG. 11 is a perspective view illustrating the appearance of a winning section 74 according to another embodiment of the present invention.

Moreover, the hit prize section 34 having formed therein a hole 34H the diameter of which is slightly greater than that of the pachinko balls B is used as the hit prize section in the present invention, but the shape and construction scope of the hit prize section is not limited thereto. For instance, as shown in FIG. 11, a hit prize section 74 may be employed in which a cutout 75 may be formed instead of the hole 34H, and a remote sensor (a pachinko ball detection sensor) 76 is arranged instead of the coil 34L. In this case, the cutout 75 of the hit prize section 74 is notched a little greater than the diameter of the pachinko ball B. Further, the remote sensor 76 is arranged to detect the pachinko ball B that passes through the cutout 75, but not to detect the pachinko ball B that passes around the hit prize section 74. Therefore, even if the hit prize section 74 is employed instead of the hit prize section 34, it is possible to accomplish the same effect as that of the hit prize section 34. Further, there may be various remote sensors 76, such as a high-frequency oscillation type remote sensor, an electrostatic capacitance type remote sensor, or a magnetic type remote sensor. Further, the shape of the hole 34H of the hit prize section 34 is not limited to a circle, but it may be formed in the shape of a rectangle or an oval. Moreover, the hole 34H may be formed in an arbitrary size of passage area on condition that the pachinko ball B can pass therethrough. In addition, the pachinko machine related to the present invention is not limited to the pachinko machine having a passage type hit prize section, but it may be constructed such that a hit prize section for collecting pachinko balls B to the back side of a game board is employed like a hit prize section in a general pachinko machine.

Further, in the embodiments of the present invention, a description is made about the pachinko machine 1 or the slot machine 101 that are constructed to be capable of selecting two types of games. However, the pachinko machine related to the invention may include all sorts of pachinko machines or slot machines where only one or more types of games can be played. Moreover, in the preferred embodiments of the present invention, a description is made about the pachinko machine 1 (or the slot machine 101) provided with a display unit 13 (or display unit 113) in which the projector unit 51 projects a display image G to the back side of the game board 31 (or the display panel 116) to thereby display it. However, the image display unit of the invention is not limited to the construction described above, but it may be constructed to display various display images G on an LCD panel or a CRT. Further, in the preferred embodiments of the present invention, the display image G is projected by the display unit 13 (or the display unit 113) onto the game board 31 (or the display panel 116). Moreover, the preferred embodiments of the invention are constructed with the kept number display unit 14 to display the number of kept pachinko balls (or coins). However, the scope of the invention is not limited thereto, but the display unit 13 (or display unit 113) may project and display a display image in which the figure image of the kept number overlaps the display image G. In this case, the kept number may be displayed with figures as shown in the preferred embodiments of the invention as well as with a ball box pattern to show the kept number of 1000, for instance, and figures indicating broken numbers of the kept number.

The entire disclosure of Japanese Patent Application Nos. 2002-298988 filed Oct. 11, 2002 and 2003-185620 filed Jun. 27, 2003 are incorporated by reference.

What is claimed is:

1. A game machine comprising:

a lending management unit managing lending of game balls;

a game mechanism having a game ball shooting section shooting the game balls to a surface of a game board, and a winning section arranged on the game board allowing the game balls to pass therethrough;

a controller performing winning processing to cause a predetermined number of the game balls to be disbursed to a ball receiver when the game balls have passed through the winning section, calculating a number of kept game balls based on a disbursed number of game balls, a number of game balls lent by the lending management unit, and a number of game balls shot by the game ball shooting section, and generating reserved number information on the game balls based on the calculated number of game balls; and a kept number display unit displaying the number of kept game balls, a reserved number recording unit readably recording in an external device the reserved number information generated by the controller, wherein the lending management unit selectively performs one of settlement lending processing to lend a number of game balls corresponding to a lending fee when the lending fee of game balls is settled according to a predetermined settlement method, and reservation lending processing for lending the game balls within a range of the reserved number specified based on the reserved number information recorded in the external device, and wherein the game mechanism is constructed to cyclically use a predetermined number of game balls to thereby supply to the game ball shooting section the game balls that have passed through the winning section, the game balls that are collected from a game ball collection pocket, and the game balls that are contained in the ball receiver.

2. The game machine according to claim 1, wherein a top opening of the ball receiver is covered with a transparent material, and the lending management unit supplies the lent game balls to the ball receiver.

3. The game machine according to claim 1, further comprising:

a storage unit storing image information corresponding to respective game images for a plurality of kinds of games and display procedure information indicating a display procedure of the game images for the plurality of kinds of games;

an image display unit displaying the game images according to the image information and the display procedure information stored in the storage unit; and an operation unit selecting any one of the plurality of kinds of games, wherein, when any one of the games is selected, the controller outputs specific information specifying the display procedure information on the selected game to the image display unit, and wherein the image display unit displays the corresponding game image according to the display procedure information specified by the specific information outputted by the control unit.

4. The game machine according to claim 3, wherein the image display unit comprises:

a projection mechanism projecting the corresponding game image onto the game board from the back side thereof; and a display controller making the projection mechanism project the corresponding game image according to the display procedure information specified based on the specific information, and wherein the storage unit stores board surface pattern information on respective board surface patterns for the games, and the display controller makes the projection mechanism project the corresponding board surface pattern and the game images for the selected game according to the specific display procedure information.

5. The game machine according to claim 3, wherein the winning section comprises:

at least one of a hole and a cutout formed to pass the game balls from one surface of the game board to the other surface of the game board, and a game ball detection sensor outputting a detection signal when a game ball passes through the corresponding cutout or hole.

6. The game machine according to claim 5, further comprising a plurality of winning sections which are slidably arranged on the game board between a protruded position protruding from the one surface of the game board for allowing the game balls to pass through the hole or cutout, and a recessed position recessed into the game board for preventing the game balls from passing through the hole or cutout, and wherein the control unit makes each winning section slide to the protruded or recessed position in accordance with the selected game.

7. The game machine according to claim 3, further comprising at least one of accessories and a plurality of nails movably arranged on a surface of the game board, wherein the controller moves at least one of the accessories and the plurality of nails in accordance with the selected game.

8. The game machine according to claim 1, wherein the lending management unit is constructed to perform the settlement lending processing for receiving the lending fee by using at least one of cash, prepaid cards, and substitute settlement means as a predetermined settlement method.

9. The game machine according to claim 1, wherein the reserved number recording unit makes the external device record the reserved number information in relation to prescribed certifying information, and wherein the lending management unit allows for the lending when the input information inputted at the time of the reservation lending processing is identical to the predetermined certifying information.

10. The game machine according to claim 1, wherein the reserved number recording unit makes a removable media, serving as the external device, readably record the reserved number information.

11. The game machine according to claim 1, wherein the reserved number recording unit readably records the reserved number information in the external device.

12. A game system comprising the game machine according to claim 11 and a central management device, serving as an external device, constructed to be accessible to the game machine through a communication network for recording the reserved number information.

13. The game system according to claim 12, further comprising a prize exchange processing device constructed to be accessible to the central management device through the communication network for reading the reserved number information from the central management device, for performing a prize exchange process within the range of the reserved number of coins specified by the read-out reserved number information to thereby generate new reserved number information reduced by the reserved number corresponding to the exchanged prize, and for recording the generated new reserved number information at the central management device.

14. The game system according to claim 12, wherein the game machine is installed in a user enterable and movable box, and the box has illumination equipment installed therein.

15. A game machine comprising:

a lending management unit lending coins;

a game mechanism having an input hole for inserting the coins and a handle for starting a lot-drawing;

a controller performing a lot-drawing process in response to the inserting of the coins and manipulation of the handle, to thereby make a coin mechanism disburse a predetermined number of coins to a coin receiver when a winning lot is generated in the lot-drawing process, calculating a number of kept coins based on a disbursed number of coins, a number of coins lent by the lending management unit, and a number of coins inserted into the input hole, and generating information on a reserved number of coins based on a calculated number of kept coins; and a display unit displaying the number of kept coins:

a reserved number recording unit readably recording in an external device information on the reserved number of coins generated by the controller, wherein the lending management unit selectively performs one of settlement lending processing to lend the number of coins corresponding to a lending fee when the lending fee of coins is settled according to a predetermined settlement method, and reservation lending processing for lending the coins within a range of the reserved number of coins specified based on the information on the reserved number of coins recorded in the external device, and wherein the game mechanism is constructed to cyclically use a predetermined number of coins including the coins that have been inserted into the input hole and the coins in the coin receiver.

16. The game machine according to claim 15, wherein a top opening of the coin receiver is covered with a transparent material, and the lending management unit supplies the lent coins to the coin receiver, and the coins in the coin receiver are inserted into the coin input hole by a conveying mechanism.

17. The game machine according to claim 15, further comprising:

a storage unit storing image information corresponding to respective game images for a plurality of kinds of games and display procedure information indicating a display procedure of the game images for the plurality of kinds of games;

an image display unit displaying the game images according to the image information and the display procedure information stored in the storage unit; and a manipulator for selecting any one of the plurality of kinds of games, wherein, when any one of the games is selected, the controller outputs specific information specifying the display procedure information on the selected game to the image display unit, and wherein the image display unit displays the corresponding game image according to the display procedure information specified by the specific information outputted by the control unit.

18. The game machine according to claim 17, wherein the image display unit comprises:

a projection mechanism projecting the corresponding game image onto a game board, from the back side thereof, arranged at the front side of the game machine, and a display controller making the projection mechanism project the corresponding game image according to the display procedure information specified based on the specific information, and wherein the storage unit stores board surface pattern information on respective board surface patterns for the games, and the display controller makes the projection mechanism project the corresponding board surface pattern and the game images for the selected game according to the specific display procedure information.

* * * * *